US006140034A

United States Patent [19]

Naruse et al.

[11] Patent Number: 6,140,034

[45] **Date of Patent: *Oct. 31, 2000**

[54] SILVER HALIDE COLOR PHOTOGRAPHIC LIGHT-SENSITIVE MATERIAL AND METHOD OF FORMING COLOR IMAGES

[75] Inventors: Hideaki Naruse; Tetsuro Kojima, both of Kanagawa, Japan

[73] Assignee: Fuji Photo Film Co., Ltd., Minami-Ashigara, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/263,951

[22] Filed: Mar. 8, 1999

[30] Foreign Application Priority Data

Mar. 9, 1998 [JP] Japan ..... 10-074837

[51] Int. Cl.[7] ..... G03C 1/42

[52] U.S. Cl. ..... 430/566; 430/349; 430/404; 430/448

[58] Field of Search ..... 430/497, 566, 430/567

[56] References Cited

U.S. PATENT DOCUMENTS 4,665,012 5/1987 Sugimoto et al. ..... 430/567

FOREIGN PATENT DOCUMENTS 762201 3/1997 European Pat. Off. .
62-123456 6/1987 Japan .

*Primary Examiner*—Hoa Van Le
*Attorney, Agent, or Firm*—Burns, Doane, Swecker & Mathis, LLP

[57] ABSTRACT

The present invention provides a heat development light-sensitive material which shows good discrimination of an image. A silver halide color photographic light-sensitive material is provided, wherein said light-sensitive material comprises at least one compound represented by the following general formula (I) or (II) and at least one compound represented by the following general formula (III) as a developing agent:

General formula (I)

General formula (II)

General formula (III)

8 Claims, No Drawings

SILVER HALIDE COLOR PHOTOGRAPHIC LIGHT-SENSITIVE MATERIAL AND METHOD OF FORMING COLOR IMAGES

BACKGROUND OF THE INVENTION

1. Field of the Invention

The present invention relates to a novel silver halide color photographic light-sensitive material for recording an image and to a method of forming color images utilizing the material.

2. Description of the Related Art

The color photograph method now in common use usually adopts an optical printing method utilizing color reproduction using a subtractive color process. Generally, a color negative light-sensitive material comprises a layer which forms a yellow dye image by recording a blue light, a layer which forms a magenta dye image by recording a green light, and a layer which forms a cyan dye image by recording a red light. When this light-sensitive material is exposed image-wise and developed, a developing agent is oxidized in a process in which a silver halide particle containing a latent image is reduced to silver, and a dye image is formed by the reaction (coupling) of the oxidation product with a coupler. The undeveloped silver halide and developed silver are removed in the following bleaching and fixing processes. When exposure onto color paper is performed through the resulting negative dye image and the same, developing, bleaching and fixing treatments are performed, a color print is obtained.

In contrast to this type of classical method of forming an image, it has also become possible recently to enhance the image quality of a print by converting image information recorded on the color negative light-sensitive material into digital information using a scanner, and by performing various image processing on this information. Miniature laboratory systems equipped with this technology have actually been announced.

However, the above-described methods are based on normal wet developing, bleaching and fixing and the processes therefor are complicated and treatment of resulting waste liquid is an environmental burden.

From this type of background, there is an increasing need for reducing the burden on the environment and improving simplicity by constructing a system which dose not use processing solutions containing the color developing and bleaching agents used in current color image forming systems.

In light of the aforementioned problems, various improved techniques have been proposed. For example, Fuji Photo Film Co., Ltd. has proposed a Pictrography System which dispenses with a processing solution containing a color developing agent. In this system, a small amount of water is supplied to a light-sensitive member containing a base precursor. The light-sensitive member and an image receiving material are contacted together and heated to promote the developing reaction. This system does not use a processing bath containing a color developing agent and, in this regard, is advantageous with respect to environmental protection. Accordingly, it is clear from the first that this system maybe used in the image formation of projection image-forming materials.

As an example thereof, Japanese Patent Application Laid-Open (JP-A) Nos. 9-10,506, 9-146,247, 9-146,248 and 9-204,031 and EP 0,762,201 Al describe a method in which a color-developed image is obtained in a light-sensitive material by using a developing agent and a coupler contained in the light-sensitive material.

This method is an excellent method in which an image having high image quality is obtained by simple treatment, however, the discrimination of the image has not been satisfactory.

SUMMARY OF THE INVENTION

Therefore, an object of the present invention is to provide a thermal developing light-sensitive material exhibiting excellent image discrimination.

The present inventors have made intensive studies, and as a result, the above-described object has been effectively accomplished by the following <1> to <4>.

<1> A silver halide color photographic light-sensitive material comprising a support and a photographic constitutional layer provided thereon which includes at least one photographic light-sensitive layer containing a light-sensitive silver halide, a developing agent and a binder, wherein the light-sensitive material, after exposure, is contacted with a processing material comprising a support and a constitutional layer provided thereon which includes a processing layer containing at least a base and/or a base precursor, in the presence of water present between the light-sensitive material and the processing material in an amount of 10% to 100% of that required to maximally swell the all coated layers of the materials, and subsequently heated to form an image in the light-sensitive material, wherein said light-sensitive material comprises at least one compound represented by the following general formula (I) or (II) and at least one compound represented by the following general formula (III) as said developing agent:

General formula (I)

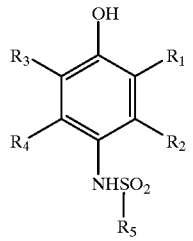

wherein, $R_1$, $R_2$, $R_3$ and $R_4$ each independently represents a hydrogen atom, halogen atom, alkyl group, aryl group, alkylcarbonamide group, arylcarbonamide group, alkylsulfonamide group, arylsulfonamide group, alkoxy group, aryloxy group, alkylthio group, arylthio group, alkylcarbamoyl group, arylcarbamoyl group, carbamoyl group, alkylsulfamoyl group, arylsulfamoyl group, sulfamoyl group, cyano group, alkylsulfonyl group, arylsulfonyl group, alkoxycarbonyl group, aryloxycarbonyl group, alkylcarbonyl group, arylcarbonyl group or acyloxy group; and $R_5$ represents an alkyl group, aryl group or heterocyclic group.

General formula (II)

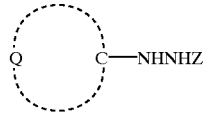

wherein, Z represents a carbamoyl group, acyl group, alkoxycarbonyl group, aryloxycarbonyl group, sulfonyl group or sulfamoyl group; and Q represents a group of atoms which forms an unsaturated ring together with carbon atoms.

General formula (III)

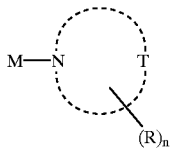

wherein, T represents a group of atoms required for forming a 5- or 6-membered heterocyclic ring. This heterocyclic ring may be condensed with a carboaromatic ring or a heteroaromatic ring. R represents a halogen atom, a substituted or unsubstituted aliphatic hydrocarbon group having 4 to 16 carbon atoms, an alkenyl group, alkynyl group, aralkyl group, aryl group, heterocyclic group, alkoxy group, aryloxy group, amino group, acylamino group, ureide group, thioureide group, urethane group, sulfonamide group, sulfamoyl group, carbamoyl group, sulfonyl group, sulfinyl group, oxycarbonyl group, acyl group, acyloxy group, phosphoric amide group, alkylthio group, arylthio group, cyano group, sulfo group, carboxy group, hydroxy group, phosphono group or nitro group; n represents 1 or 2; and M represents a hydrogen atom, alkaline metal atom or ammonium group.

<2> The silver halide color photographic light-sensitive material according to <1>, wherein the compound represented by said general formula (III) is a compound represented by the following general formula (IV):

General formula (IV)

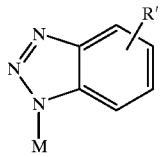

wherein, R' represents a substituted or unsubstituted aliphatic hydrocarbon group having 4 to 16 carbon atoms, an alkenyl group, alkynyl group, aralkyl group, aryl group, heterocyclic group, alkoxy group, aryloxy group, amino group, acylamino group, ureide group, urethane group, sulfonamide group, sulfamoyl group, carbamoyl group, sulfonyl group, oxycarbonyl group, acyl group, acyloxy group, alkylthio group or arylthio group; and M represents a hydrogen atom, alkaline metal atom or ammonium group.

<3> The silver halide color photographic light-sensitive material according to <1> or <2>, further comprising a coupler which forms a dye by conducting a coupling reaction with the oxidation product of a developing agent represented by the general formula (I) or (II).

<4> A method of forming a color image, wherein the silver halide color photographic light-sensitive material according to anyone of <1> to <3>, after image-wise exposure, is contacted with a processing material, in the presence of water present between the light-sensitive material and the processing material in an amount of 10% to 100% of that required to maximally swell the all coated layers of the materials, and subsequently heated at a temperature from 60° C. to 100° C. for 5 seconds to 60 seconds to form an image in the light-sensitive material.

DESCRIPTION OF THE PREFERRED EMBODIMENTS

The present invention will be described in detail below.

(Developing agent)

The light-sensitive material of the present invention comprises a compound represented by the general formula (I) or (II) as a developing agent.

In the general formula (I), each of $R_1$ to $R_4$ represents a hydrogen atom, a halogen atom (e.g., chrolo, or bromo), an alkyl group (e.g., methyl, ethyl, isopropyl, n-butyl, or t-butyl), an aryl group (e.g., phenyl, tolyl, or xylyl), an alkylcarbonamide group (e.g., acetylamino, propionylamino, butyroylamino), an arylcarbonamide group (e.g., benzoylamino), an alkylsulfonamide group (e.g., methanesulfonylamino or ethanesulfonylamino), an arylsulfonamide group (e.g., benzenesulfonylamino or toluenesulfonylamino), an alkoxy group (e.g., methoxy, ethoxy, or butoxy), an aryloxy group (e.g., phenoxy), an alkylthio group (e.g., methylthio, ethylthio, or buthylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl, or morpholylcarbamoyl), an arylcarbamoyl group (e.g., phenylcarbamoyl, methylphenylcarbamoyl, ethylphenylcarbamoyl, benzylphenylcarbamoyl), a carbamoyl group, an alkylsulfamoyl group (e.g., methylsulfamoyl, methylphenylsulfamoyl, ethylphenylsulfamoyl, or benzylphenylsulfamoyl), an arylsulfamoyl group, a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl, or p-toluenesulfonyl), an alkoxycarbonyl group (e.g., methoxycarbonyl, ethoxycarbonyl, or butoxycarbonyl), an aryloxycarbonyl group (e.g., phenoxycarbonyl), an alkylcarbonyl group (e.g., acetyl, propionyl, or butyroyl), an arylcarbonyl group (e.g., benzoyl or alkylbenzoyl), or an acyloxy group (e.g., acetyloxy, propionyloxy, or butyroyloxy).

Of groups $R_1$ to $R_4$, $R_2$ and $R_4$ are preferably hydrogen atoms. A sum of the Hammett's substituent constant up of $R_1$ to $R_4$ is preferably not less than 0. $R_5$ represents an alkyl group (e.g., methyl, ethyl, butyl, octyl, lauryl, cetyl, or stearyl), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl, or 3,5-di-(methoxycarbonyl)), or a heterocyclic group.

In the general formula (II), Z represents a carbamoyl group, acyl group, alkoxycarbonyl group, aryloxycarbonyl group, sulfonyl group or sulfamoyl group. Among these, a carbamoyl group is preferable, and a carbamoyl group having a hydrogen atom on a nitrogen atom is particularly preferable.

As the carbamoyl group, a carbamoyl group having 1 to 50 carbon atoms is preferable and one having 6 to 40 carbon atoms is more preferable. Specific examples thereof include a carbamoyl group, methylcarbamoyl group, ethylcarbamoyl group, n-propylcarbamoyl group, sec-butylcarbamoyl group, n-octylcarbamoyl group, cyclohexylcarbamoyl group, tert-butylcarbamoyl group, dodecylcarbamoyl group, 3-dodecyloxypropylcarbamoyl group, octadecylcarbamoyl group, 3-(2,4-tert-pentylphenoxy)propylcarbamoyl group, 2-hexyldecylcarbamoyl group, phenylcarbamoyl group, 4-dodecyloxyphenylcarbamoyl group, 2-chloro-5-dodecyloxycarbonylphenylcarbamoyl group, naphthylcarbamoyl group, 3-pyridylcarbamoyl group, 3,5-bis-octyloxycarbonylphenylcarbamoyl group, 3,5-bis-tetradecyloxyphenylcarbamoyl group, benzyloxycarbamoyl group, 2,5-dioxo-1-pyrrolidinylcarbamoyl group and the like.

As the acyl group, an acyl group having 1 to 50 carbon atoms is preferable, and one having 6 to 40 carbon atoms is more preferable. Specific examples thereof include a formyl group, acetyl group, 2-methylpropanoyl group, cyclohexylcarbonyl group, n-octanoyl group, 2-hexyldecanoyl group, dodecanoyl group, chloroacetyl group, trifluoroacetyl group, benzoyl group, 4-dodecyloxybenzoyl group, 2-hydroxymethylbenzoyl group, 3-(N-hydroxy-N-methylaminocarbonyl)propanyl group and the like.

As the alkoxycarbonyl group and aryloxycarbonyl group, an alkoxycarbonyl group and an aryloxycarbonyl group having 2 to 50 carbon atoms are preferable and an alkoxycarbonyl group and aryloxycarbonyl group having 6 to 40 carbon atoms are more preferable. Specific examples thereof include a methoxycarbonyl group, ethoxycarbonyl group, isobutyloxycarbonyl group, cyclohexyloxycarbonyl group, dodecyloxycarbonyl group, benzyloxycarbonyl group, phenoxycarbonyl group, 4-octyloxyphenoxycarbonyl group, 2-hydroxymethylphenoxycarbonyl group, 4-dodecyloxyphenoxycarbonyl group and the like.

As the sulfonyl group, a sulfonyl group having 1 to 50 carbon atoms is preferable, and one having 6 to 40 carbon atoms is more preferable. Specific examples thereof include a methylsulfonyl group, butylsulfonyl group, octylsulfonyl group, 2-hexyldecylsulfonyl group, 3-dodecyloxypropylsulfonyl group, 2-n-octyloxy-5-t-octylphenylsulfonyl group, 4-dodecyloxyphenylsulfonyl group and the like.

As the sulfamoyl group, a sulfamoyl group having 1 to 50 carbon atoms is preferable, and one having 6 to 40 carbon atoms is more preferable. Specific examples thereof include a sulfamoyl group, ethylsulfamoyl group, 2-ethylhexylsulfamoyl group, decylsulfamoyl group, hexadecylsulfamoyl group, 3-(2-ethylhexyloxy)propylsulfamoyl group, (2-chloro-5-dodecyloxycarbonylphenyl)sulfamoyl group, 2-tetradecyloxyphenylsulfamoyl group and the like.

In the general formula (II), Q represents an atom group which forms an unsaturated ring together with carbon atoms, and as the unsaturated ring formed, a 3 to 8-membered ring is preferable, and a 5 to 6-membered ring is more preferable. Examples thereof include a benzene ring, pyridine ring, pyradine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, thiophene ring and the like. And condensed rings obtained by condensation of these rings are also preferably used.

The rings may further have a substituent, and examples of the substituent include linear or branched, linear or cyclic alkyl groups having 1 to 50 carbon atoms (such as trifluoromethyl, methyl, ethyl, propyl, heptafluoropropyl, isopropyl, butyl, t-butyl, t-pentyl, cyclopentyl, cyclohexyl, octyl, 2-ethylhexyl, dodecyl and the like), linear or branched, linear or cyclic alkenyl groups having 2 to 50 carbon atoms (such as vinyl, 1-methylvinyl, cyclohexene-1-yl and the like), alkynyl groups having 2 to 50 carbon atoms in total (such as ethynyl, 1-propynyl and the like), aryl groups having 6 to 50 carbon atoms (such as phenyl, naphthyl, anthryl and the like), acyloxy groups having 1 to 50 carbon atoms (such as acetoxy, tetradecanoyloxy, benzoyloxy and the like), alkoxycarbonyloxy groups having 2 to 50 carbon atoms (such as methoxycarbonyloxy, 2-methoxyethoxycarbonyloxy groups and the like), aryloxycarbonyloxy groups having 7 to 50 carbon atoms (such as a phenoxycarbonyloxy group and the like), carbamoyloxy groups having 1 to 50 carbon atoms (such as N,N-dimethylcarbamoyloxy and the like), carbonamide groups having 1 to 50 carbon atoms (such as formamide, N-methylacetamide, acetamide, N-methylformamide, benzamide and the like), sulfonamide groups having 1 to 50 carbon atoms (such as methanesulfonamide, dodecanesulfonamide, benzenesulfonamide, p-toluenesulfonamide and the like), carbamoyl groups having 1 to 50 carbon atoms (such as N-methylcarbamoyl, N,N-diethylcarbamoyl, and the like), sulfamoyl groups having 0 to 50 carbon atoms (such as N-butylsulfamoyl, N,N-diethylsulfamoyl, N-methyl-N-(4 -methoxyphenyl) sulfamoyl and the like), alkoxy groups having 1 to 50 carbon atoms (such as methoxy, propoxy, isopropoxy, octyloxy, t-octyloxy, dodecyloxy, 2-(2,4-di-t-pentylphenoxy)ethoxy and the like), aryloxy groups having 6 to 50 carbon atoms (such as phenoxy, 4-methoxyphenoxy, naphthoxy and the like), aryloxycarbonyl groups having 7 to 50 carbon atoms (such as phenoxycarbonyl, naphthoxycarbonyl and the like), alkoxycarbonyl groups having 2 to 50 carbon atoms (such as methoxycarbonyl, t-butoxycarbonyl and the like), N-acylsulfamoyl groups having 1 to 50 carbon atoms (such as N-tetradecanoylsulfamoyl, N-benzoylsulfamoyl and the like), N-sulfamoylcarbamoyl groups having 1 to 50 carbon atoms (such as N-methanesulfonylcarbamoyl group and the like), alkylsulfonyl groups having 1 to 50 carbon atoms (such as methanesulfonyl, octylsulfonyl, 2-methoxyethylsulfonyl, 2-hexyldecylsulfonyl and the like), arylsulfonyl groups having 6 to 50 carbon atoms (such as benzensulfonyl, p-toluenesulfonyl, 4-phenylsulfonyl, phenylsulfonyl and the like), alkoxycarbonylamino groups having 2 to 50 carbon atoms (such as ethoxycarbonylamino and the like), aryloxycarbonylamino groups (such as phenoxycarbonylamino, naphthoxycarbonylamino and the like), amino groups having 0 to 50 carbon atoms (such as amino, methylamino, diethylamino, diisopropylamino, anilino, morpholino and the like), ammonio groups having 3 to 50 carbon atoms (such as trimethylammonio, dimethylbenzylammonio groups and the like), a cyano group, a nitro group, a carboxyl group, a hydroxy group, a sulfo group, a mercapto group, alkylsulfinyl groups having 1 to 50 carbon atoms (such as methanesulfinyl, octanesulfinyl and the like), arylsulfinyl groups having 6 to 50 carbon atoms (such as benzenesulfinyl, 4-chlorophenylsulfinyl, p-toluenesulfinyl and the like), alkylthio groups having 1 to 50 carbon atoms (such as methylthio, octylthio, cyclohexylthio and the like), arylthio groups having 6 to 50 carbon atoms (such as phenylthio, naphthylthio and the like), ureide groups having 1 to 50 carbon atoms (such as 3-methylureide, 3,3-dimethylureide, 1,3-diphenylureide and the like), heterocyclic groups having 2 to 50 carbon atoms (such as 3 to 12-membered monocyclic or condensed rings containing at least one hetero atom such as nitrogen, oxygen, sulfur and the like, for example, 2-furyl, 2-pyranyl, 2-pyridyl, 2-thienyl, 2-imidazolyl, morpholino, 2-quinolyl, 2-benzimidazolyl, 2-benzothiazolyl, 2-benzoxazolyl and the like), acyl groups having 1 to 50 carbon atoms (such as acetyl, benzoyl, trifluoroacetyl and the like), sulfamoylamino groups having 0 to 50 carbon atoms (such as N-butylsulfamoylamino, N-phenylsulfamoylamino and the like), silyl groups having 3 to 50 carbon atoms (such as trimethylsilyl, dimethyl-t-butylsilyl, triphenylsilyl and the like), and halogen atoms (such as fluorine, chlorine, bromine atoms and the like).

The above-described substituent may have a further substituent, and examples thereof include those listed above. The number of carbon atoms of the substituent is preferably 50 or less, more preferably 42 or less and further preferably 30 or less.

For sufficient diffusion ability of a dye which is produced by the reaction of a developing agent with a coupler in the present invention, the total number of carbon atoms of an unsaturated ring formed from Q and carbon atoms and a substituent thereof is preferably from 1 to 30, more preferably from 1 to 24, and particularly preferably from 1 to 18.

When the ring formed from Q and carbon atoms is composed solely of carbon atoms (such as benzene, naphthalene, anthracene rings and the like), the total value of Hammett substituent constants ((in the case of ortho (2 position), para (4 position), - - - relative to a carbon atom, σp value is adopted, and in the case of meta (3 position), meta (5 position), - - - relative to a carbon atom, σm value is adopted) of all substituents is preferably 0.8 or more, more preferably 1.2 or more and most preferably 1.5 or more.

The details of Hammett substituent constants σp and σm are described in detail in, for example, N. Inamoto, "Hammett rule—structure and reactivity—" (Maruzen), "New Experimental Chemical Seminar 14 Synthesis and Reaction of Organic Compound V" p.2605 (Japan Chemical Institute edit., Maruzen), T. Nakaya, "Theoretical Organic Chemistry Commentary" p.217 (Tokyo Chemical Coterie), Chemical Review, 91, pp. 165 to 195 (1991) and the like.

Specific examples of the compound represented by the general formula (I) or (II) will be described below, however, they do not limit the scope of the present invention.

I-1

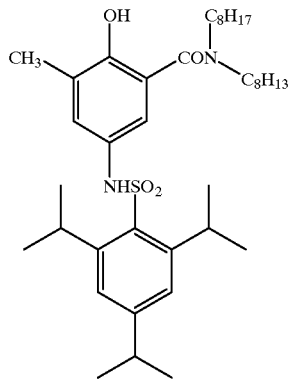

I-2

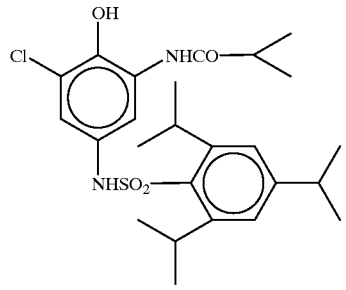

I-3

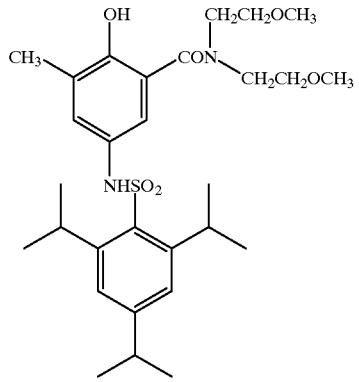

-continued
I-4
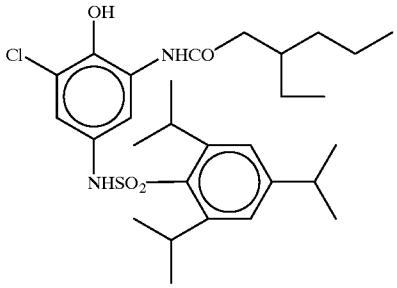
I-5
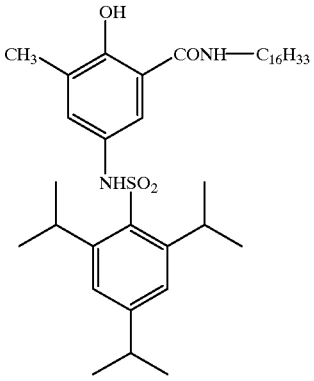
I-6
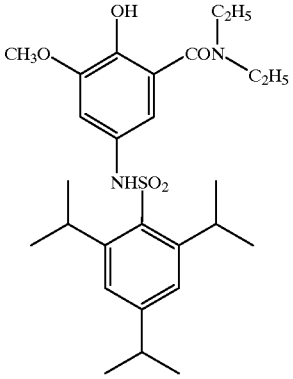
I-7
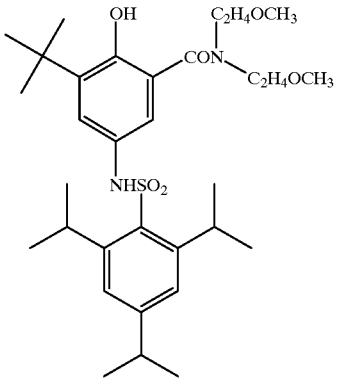
-continued
I-8
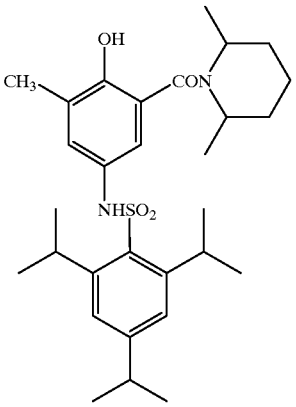
I-9
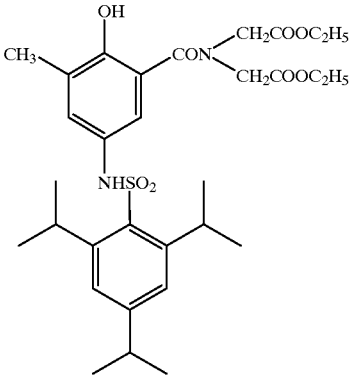
I-10
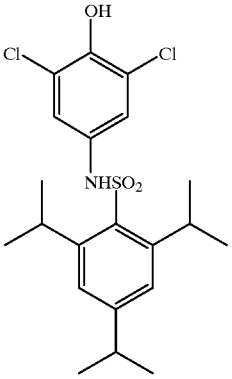
I-11
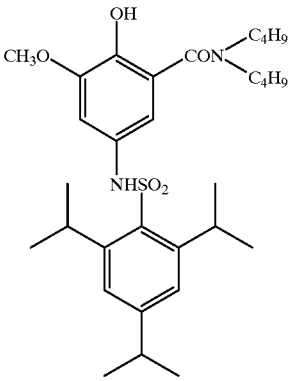

-continued
I-12
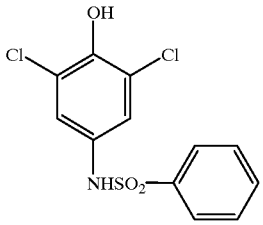
I-13
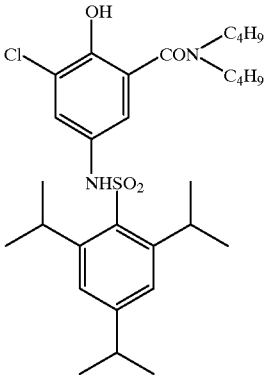
I-14
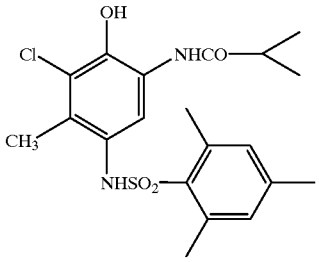
I-15
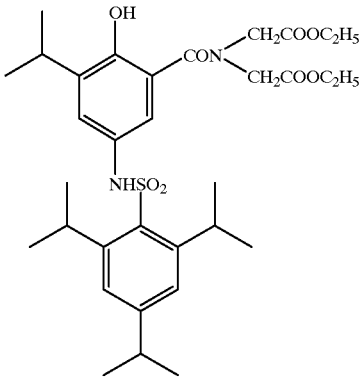
-continued
I-16
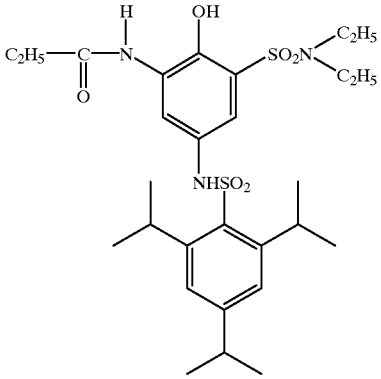
I-17
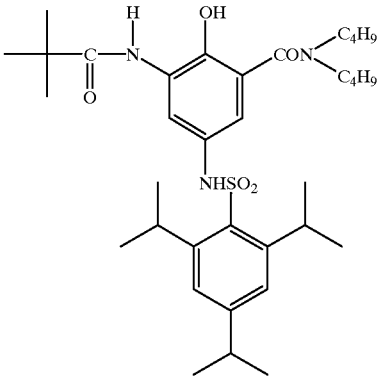
I-18
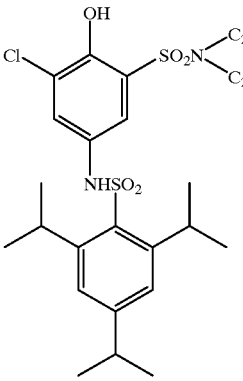
I-19
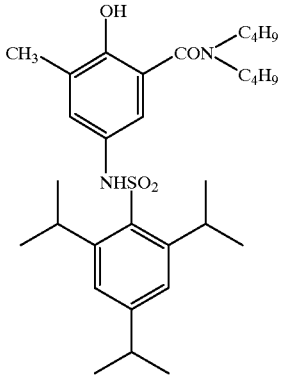

-continued
I-20
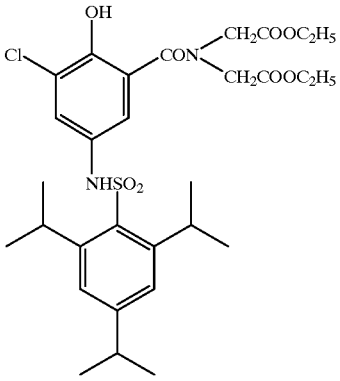
I-21
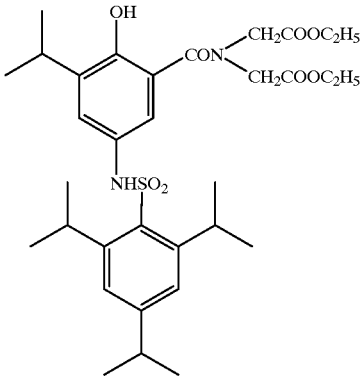
I-22
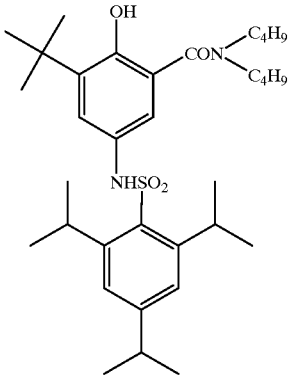
I-23
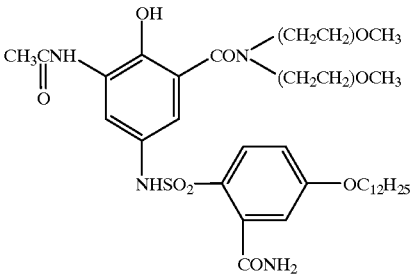
-continued
I-24
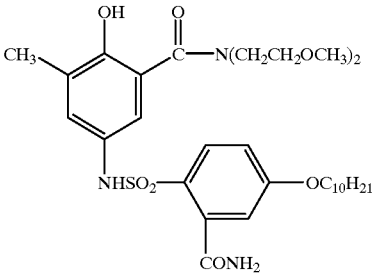
I-25
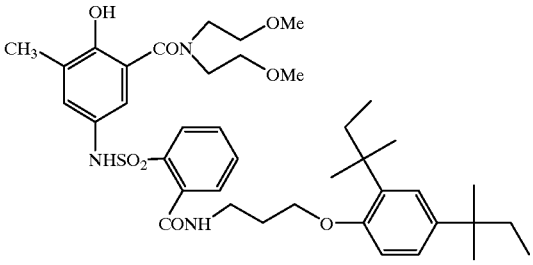
I-26
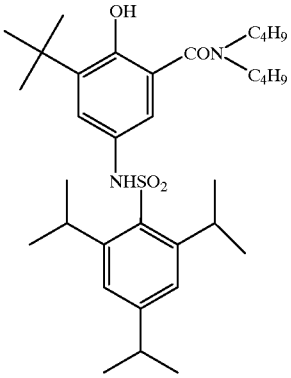
I-27
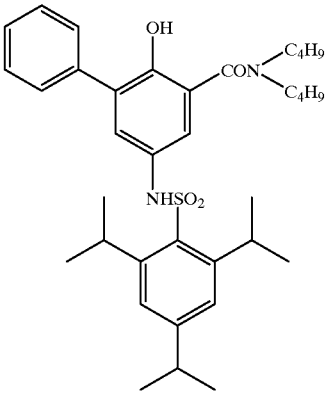

-continued
I-28
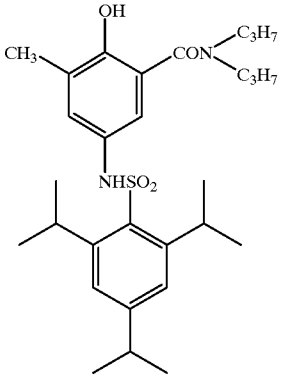
I-29
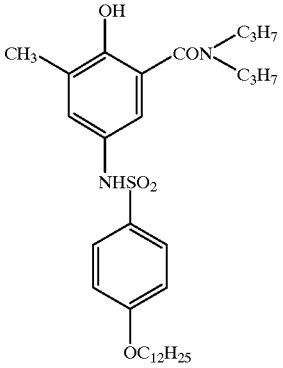
I-30
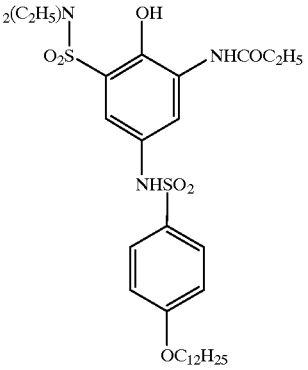
II-1
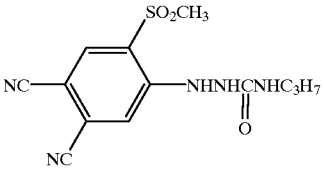
-continued
II-2
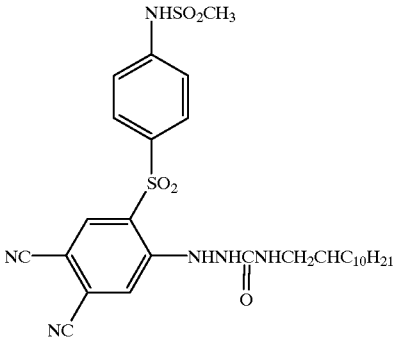
II-3
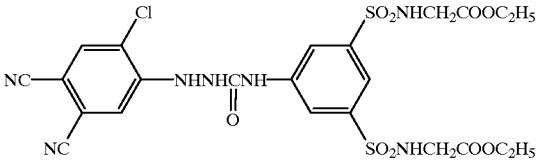
II-4
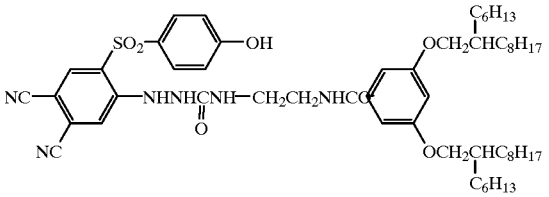
II-5
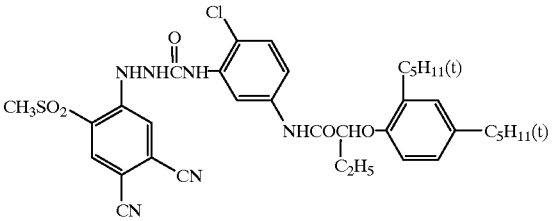
II-6
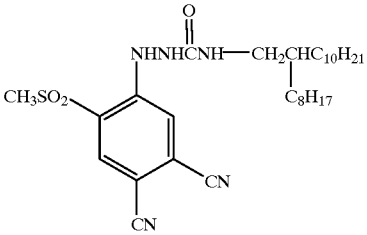
II-7
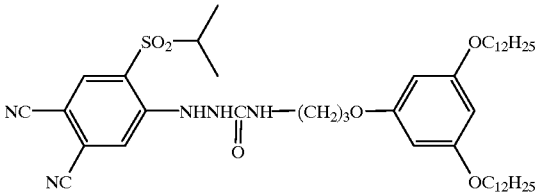

-continued
II-8
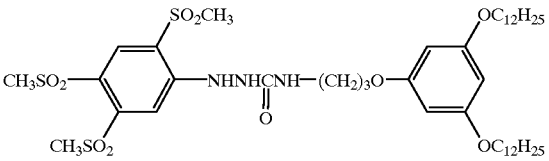
II-9
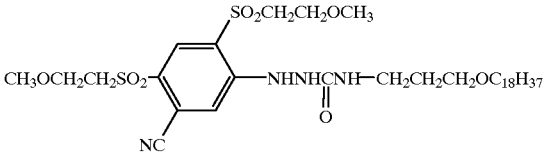
II-10
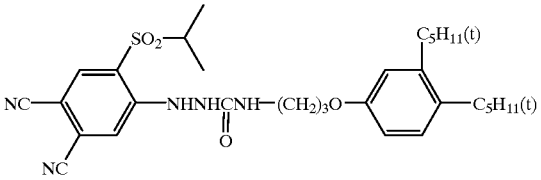
II-11
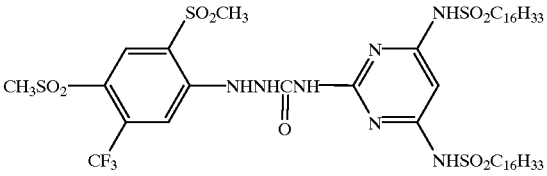
II-12
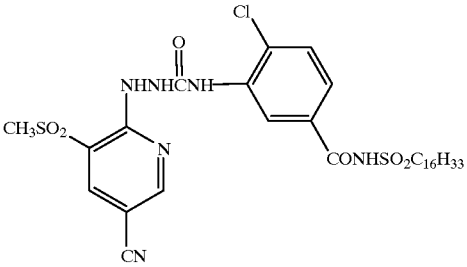
II-13
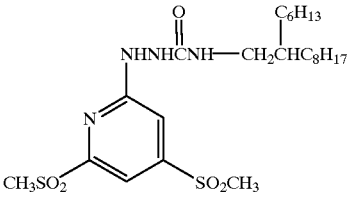
II-14
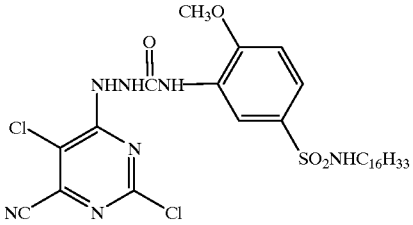
-continued
II-15
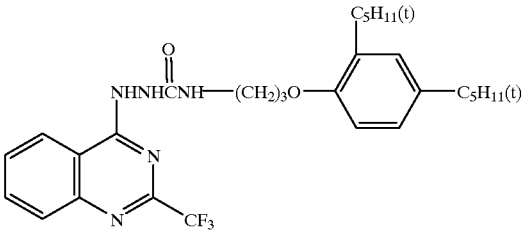
II-16
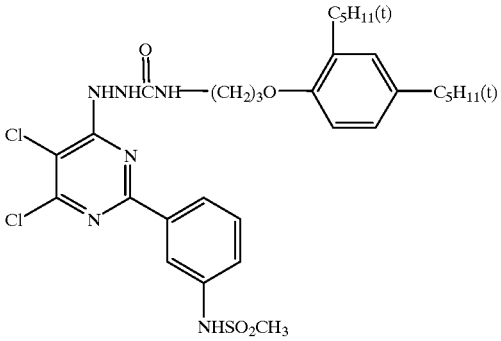
II-17
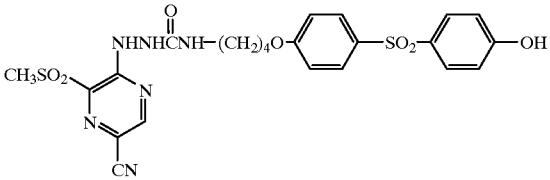
II-18
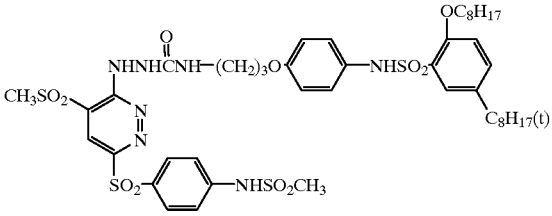
II-19
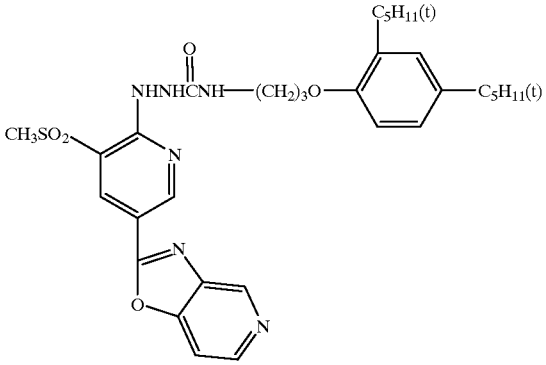
II-20
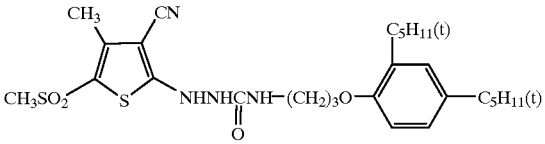

-continued

II-21

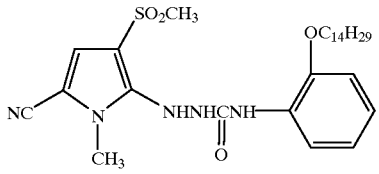

II-22

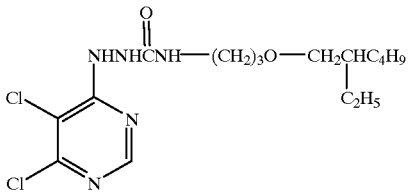

II-23

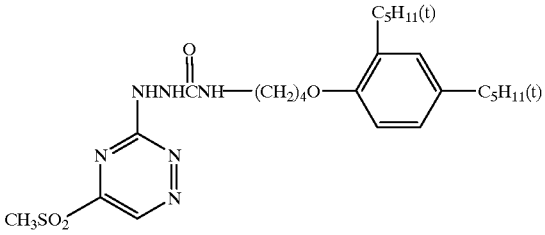

II-24

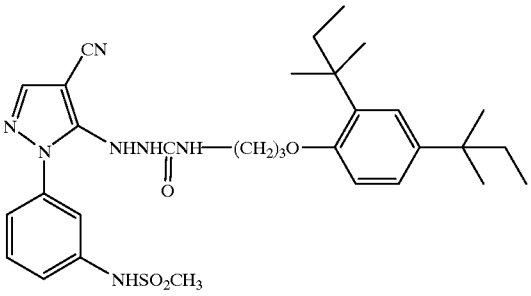

II-25

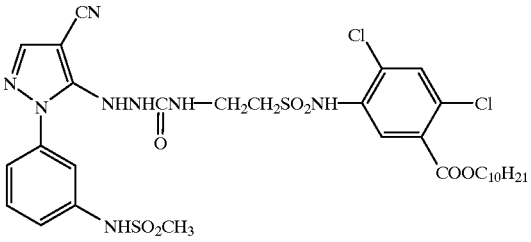

II-26

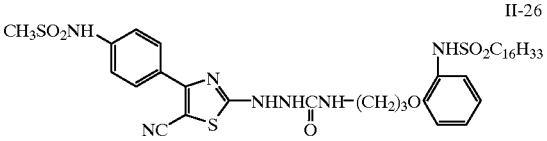

II-27

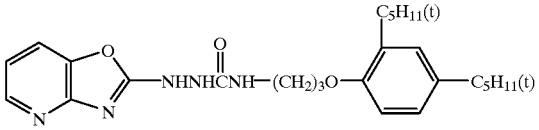

-continued

II-28

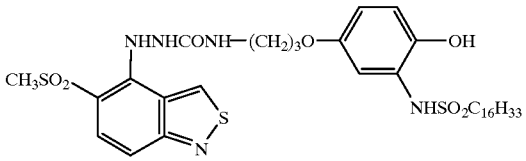

II-29

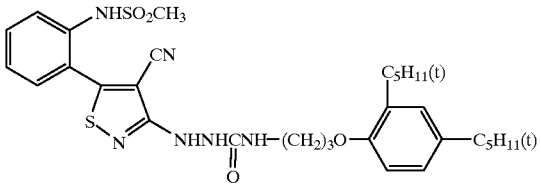

II-30

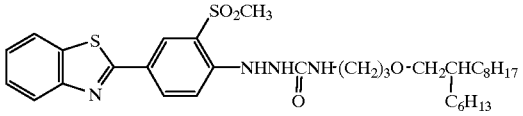

The compound represented by the general formula (I) or (II) of the present invention can be synthesized by the general method described in JP-A No. 8-286,340.

The amount used of the compound represented by the general formula (I) or (II) is from 100 to 300 mol %, preferably from 100 to 200 mol %, further preferably from 100 to 150 mol % based on the above-described coupler.

(Compound represented by general formula (III))

In the present invention, high level discrimination can be attained if the compound represented by the general formula (I) or (II) is combined with a compound represented by the general formula (III) described below.

In the general formula (III), T represents a group of atoms required for forming a 5 or 6-membered heterocyclic ring. This heterocyclic ring is preferably constituted of at least one atom from a carbon atom, nitrogen atom, oxygen atom and sulfur atom, and further, may be condensed with a carboaromatic ring or a heteroaromatic ring. Examples of the heterocyclic ring formed by T include an indazole ring, benzimidazole ring, benzotriazole ring, imidazole ring, triazole ring, tetrazole ring, tetraazaindene ring, triazaindene ring and the like. Among these, an indazole ring, benzimidazole ring, benzotriazole ring and tetraazaindene ring are preferable, and an indazole ring, benzimidazole ring and benzotriazole ring are particularly preferable.

Examples of the substituent represented by R in the general formula (III) include halogen atoms (e.g., a fluorine atom, chlorine atom, bromine atom, and the like), aliphatic hydrocarbon groups (e.g., methyl, ethyl, isopropyl, n-propyl, t-butyl, n-octyl, dodecyl, hexadecyl, cyclopentyl, cyclohexyl and the like), alkenyl groups (e.g., allyl, 2-butenyl, 3-pentenyl and the like), alkynyl groups (e.g., propalgyl, 3-pentynyl, and the like), aralkyl groups (e.g., benzyl, phenetyl, and the like), aryl groups (e.g., phenyl, naphthyl, 4-methylphenyl, and the like), heterocyclic groups (e.g., pyridyl, furyl, imidazolyl, piperidinyl, morpholyl, and the like), alkoxy groups (e.g., methoxy, ethoxy, butoxy, 2-ethylhexyloxy, ethoxyethoxy, methoxyethoxy, dodecyloxy, and the like), aryloxy groups (e.g., phenoxy, 2-naphthyloxy, and the like), amino groups (e.g., unsubstituted amino, dimethylamino, diethylamino, dipropylamino, dibutylamino, ethylamino, dibenzylamino, anilino, and the like), acylamino groups (e.g., acetylamino, benzoylamino, octanoylamino, 2-ethylhexanoylamino, dodecanoylamino, and the like), ureide groups (e.g., unsubstituted ureide, N-methylureide, N-phenylureide, hexylureide, octylureide, dodecylureide, and the like), thioureide groups (e.g., unsubstituted thioureide, N-methylthioureide, N-phenylthioureide, octylthioureide, and the like), urethane groups (e.g., methoxycarbonylamino, phenoxycarbonylamino, hexyloxycarbonylamino, and the like), sulfonamide groups (e.g., methanesulfonamide, benzenesulfonamide, octanesulfonamide, and the like), sulfamoyl groups (e.g., unsubstituted sulfamoyl group, N,N-dimethylsulfamoyl, N-phenylsulfamoyl, dibutylsulfamoyl, and the like), carbamoyl groups (e.g., unsubstituted carbamoyl, N,N-diethylcarbamoyl, N-phenylcarbamoyl, octylcarbamoyl, dodecylcarbamoyl, and the like), sulfonyl groups (e.g., mesyl, tosyl, and the like), sulfinyl groups (e.g., methylsulfinyl, phenylsulfinyl, and the like), oxycarbonyl groups (e.g., methoxycarbonyl, ethoxycarbonyl, hexyloxycarbonyl, phenoxycarbonyl, and the like), acyl groups (e.g., acetyl, benzoyl, formyl, pivaloyl, octanoyl, and the like), acyloxy groups (e.g., acetoxy, benzoyloxy, octanoyloxy, and the like), phosphoric amides (e.g., N,N-diethylphosphoric amide, and the like), alkylthio groups (e.g., methylthio, ethylthio, hexylthio, decylthio, and the like), arylthio groups (e.g., phenylthio and the like), a cyano group, sulfo group, carboxy group, hydroxy group, phosphono group, nitro group and the like.

Among these, preferable are substituted or unsubstituted aliphatic hydrocarbon groups having 4 to 16 carbon atoms, alkenyl group, alkynyl group, aralkyl group, aryl group, heterocyclic group, alkoxy group, aryloxy group, amino group, acylamino group, ureide group, urethane group, sulfonamide group, sulfamoyl group, carbamoyl group, sulfonyl group, oxycarbonyl group, acyl group, acyloxy group, alkylthio group and arylthio group.

n represents 1 or 2, and when n is 2, the two substituents may be the same or different. R may be further substituted. As the substituent to be further substituted, those described above for R are listed.

In the general formula (III), M represents a hydrogen atom, an alkaline metal atom (e.g., sodium, potassium, and the like) or an ammonium group (e.g., tetramethylammonium, trimethylbenzylammonium, and the like). Among these, a hydrogen atom and an alkaline metal atom are preferable.

As the compound represented by the general formula (III), compounds represented by the above-described general formula (IV) are particularly preferable.

In the general formula (IV), R represents a substituted or unsubstituted aliphatic hydrocarbon group having 4 to 16 carbon atoms, an alkenyl group, alkynyl group, aralkyl group, aryl group, heterocyclic group, alkoxy group, aryloxy group, amino group, acylamino group, ureide group, urethane group, sulfonamide group, sulfamoyl group, carbamoyl group, sulfonyl group, oxycarbonyl group, acyl group, acyloxy group, alkylthio group or arylthio group. R' is more preferably a substituted or unsubstituted acylamino group, ureide group, urethane group, sulfonamide group, carbamoyl group or oxycarbonyl group which has 6 to 12 carbon atoms, and particularly preferably a substituted or unsubstituted acylamino group, ureide group or carbamoyl group which has 6 to 12 carbon atoms. Wherein, the substituent R' is as defined for R in the general formula (III). M in this formula is as defined for M in the general formula (III), but is preferably a hydrogen atom.

Specific examples of the compound represented by the general formula (III) of the present invention include, but are not limited to, the following compounds.

III-1

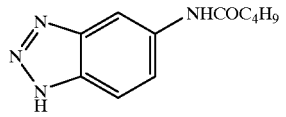

III-2

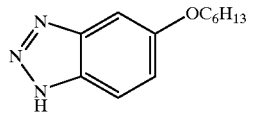

III-3

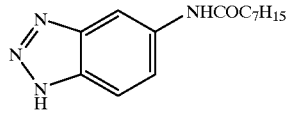

III-4

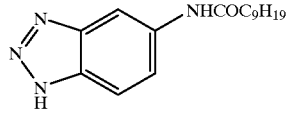

III-5

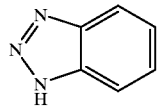

III-6

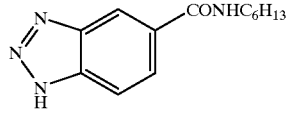

III-7

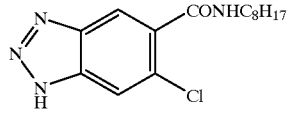

III-8

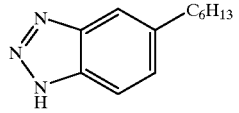

III-9

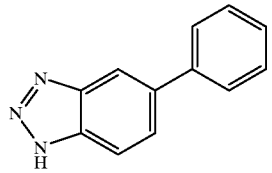

III-10

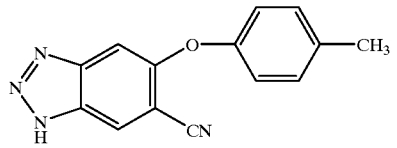

-continued
III-11
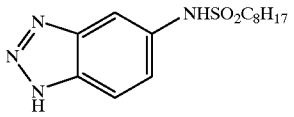
III-12
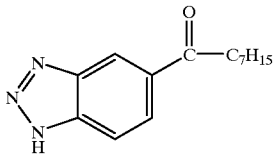
III-13
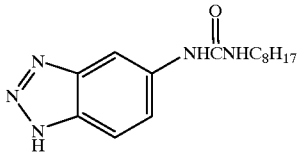
III-14
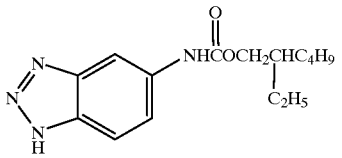
III-15
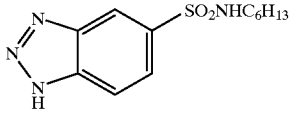
III-16
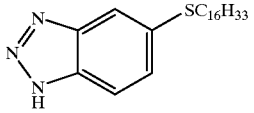
III-17
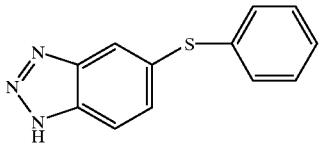
III-18
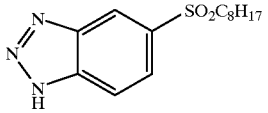
III-19
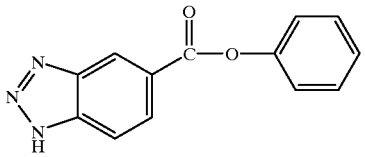
III-20
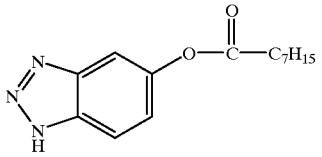
-continued
III-21
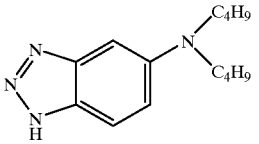
III-22
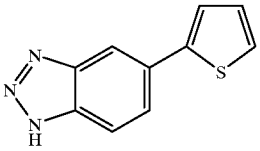
III-23
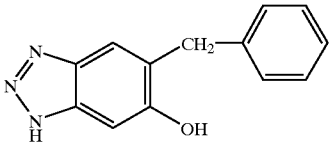
III-24
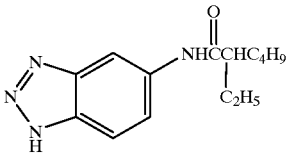
III-25
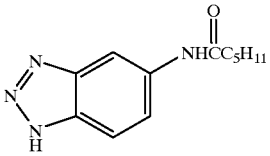
III-26
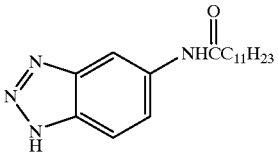
III-27
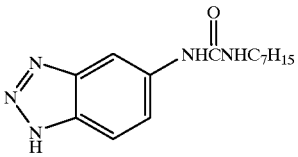
III-28
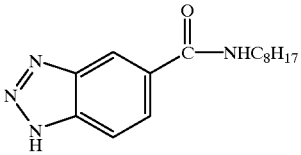
III-29
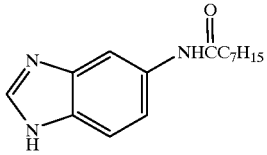

-continued

III-30

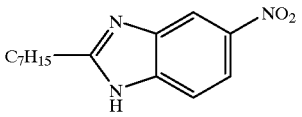

III-31

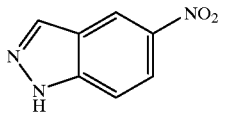

III-32

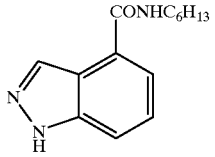

III-33

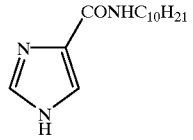

III-34

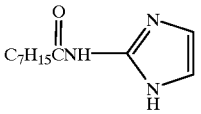

III-35

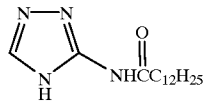

III-36

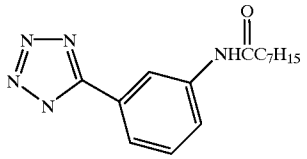

III-37

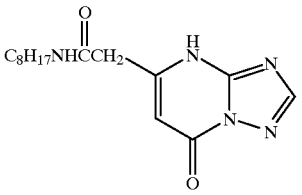

III-38

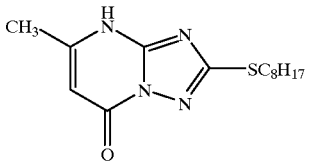

III-39

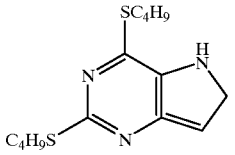

-continued

III-40

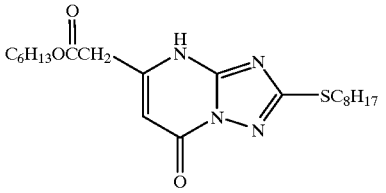

The amount used of the compound represented by the general formula (III) is from 0.1 to 100 mol %, preferably from 0.1 to 50 mol %, further preferably from 0.1 to 10 mol % based on the above-described coupler.

The method of producing the compound represented by the general formula (III) used in the present invention is not particularly restricted, and the compound can be synthesized by a known method.

For example, the compound represented by the general formula (III)-3 was synthesized by the following production method.

To 621.2 g (3 mol) of 5-aminobenzotriazole dihydrochloride was added 2 liters of dimethylacetamide and 700 ml (9 mol) of pyridine, and the mixture was stirred at room temperature (25° C.). To the resulting solution was added dropwise 512 ml (3 mol) of n-octanoyl chloride while being cooled by water so that the internal temperature thereof did not exceed 40° C. After the addition, the solution was reacted for 2 hours at room temperature and for 4 hours at 70° C., then, the solution was added to 5 liters of ice water to precipitate crystals. The precipitated crystals were separated by filtration, then, recrystallized from 10 liters of methyl alcohol and 600 ml of dimethylacetamide to obtain 644.8 g of an intended material (yield: 82.6%). It was identified as the intended material by NMR, mass spectrum and element analysis.

(Light-sensitive silver halide emulsion)

The silver halide particles constituting a silver halide emulsion which can be used in the present invention may be particles composed of any of silver iodide bromide, silver bromide, silver chloride bromide, silver iodide chloride, silver chloride and silver iodide chloride bromide. The size of the silver halide particles are from 0.1 to 2 $\mu$m, preferably from 0.2 to 1.5 $\mu$m in particular, in terms of the diameter of a sphere having the same volume.

The form of the silver halide particle used in the present invention can be that of a normal crystal such as cube, octahedron or tetradecahedron, or a tabular form such as a hexagonal or rectangular form. Among these, a tabular particle having an aspect ratio of 2 or more, preferably 8 or more, further preferably 20 or more is preferable. An emulsion in which such tabular particles occupy 50% or more, preferably 80% or more, and more preferably 90% or more of the projected area of all particles is preferably used.

Particles having a higher aspect ratio and whose particle thickness is smaller than 0.07 gm described in U.S. Pat. Nos. 5,494,789, 5,503,970, 5,503,971, 5,536,632 and the like can also be preferably used.

Silver chloride tabular particles with high concentration of silver chloride in silver halides (referred to hereinafter as "high-silver chloride") having a (111) surface as a main surface described in U.S. Pat. Nos. 4,400,463, 4,713,323, 5,217,858 and the like, and high-silver chloride tabular particles having a (100) surface as a main surface described in U.S. Pat. Nos. 5,264,337, 5,292,632, 5,310,635 and the like, can also preferably be used.

The silver halide emulsion of the present invention is usually preferably subjected to chemical sensitization and spectral sensitization.

As the chemical sensitization method, a calcogen sensitization method using a sulfur, selenium or tellurium compound, a noble metal sensitization method using gold, platinum, iridium and the like, and a so-called reduction sensitization method in which high sensitivity is obtained by introducing a reductive silver nucleus using a compound having suitable reducing ability during particle formation, can each be used alone or in various combinations thereof.

In the spectral sensitization method, a so-called spectral sensitizing dye which adheres to a silver halide particle and imparts sensitivity in its own absorption wavelength range such as a cyanine dye, merocyanine dye, complex cyanine dye, complex merocyanine dye, holopolar dye, hemicyanine dye, styryl dye, hemioxonol dye or the like is used. The spectral sensitizing dye is used alone, or alternatively used in combinations of two or more. Further, it is also preferable to use the spectral sensitizing dye together with a supersensitizing agent.

To the silver halide emulsion used in the present invention, various stabilizing agents are preferably added such as nitrogen-containing heterocyclic compounds such as azaindenes, triazoles, tetrazoles, purines and the like, mercapto compounds such as mercaptotetrazoles, mercaptotriazoles, mercaptoimidazoles, mercaptothiadiazoles and the like, for the purpose of preventing fogging and enhancing stability in storage.

Further, in the above-described silver halide emulsion, there can be preferably used photographic additives described in Research Disclosure Nos. 17643 (December, 1978), 18716 (November, 1979), 307105 (November, 1989) and 38957 (September, 1996).

The above-described light-sensitive silver halide is used in an amount of 0.05 to 20 g/m$^2$, and preferably of 0.1 to 10 g/m$^2$ in terms of silver.

(Binder)

The binder of the thermal developing color light-sensitive material in the present invention is preferably a hydrophilic binder, and examples thereof include those described in Research Disclosure and JP-A No. 64-13,546, pp. 71 to 75. μmong these, gelatin and, combinations of gelatin with other water-soluble binders, for example, polyvinyl alcohol, denatured polyvinyl alcohol, cellulose derivative, acrylamide polymer and the like, are preferable. The suitable amount applied of the binder is from 1 to 20 g/m$^2$, preferably from 2 to 15 g/m$^2$, further preferably from 3 to 12 g/m$^2$. Gelatin is used in a ratio from 50 to 100% by weight and preferably from 70 to 100% by weight in this composition.

(Coupler)

In the thermal developing color light-sensitive material of the present invention, a coupler can be used which forms a dye by conducting a coupling reaction with the oxidized product of a developing agent represented by the general formula (I) or (II). As preferable examples, there are listed compounds generically called active methylene, 5-pyrazolone, pyrazoloazole, phenol, naphthol, and pyrrolotriazole. As specific examples thereof, those referred to in Research Disclosure No. 38957 (September, 1996) pp. 616 to 624 can be preferably used. As particularly preferable examples, there are listed pyrazoloazole couplers as described in JP-A No. 8-110,608, and pyrrolotriazole couplers as described in JP-A Nos. 8-122,994, 8-45,564 and the like.

These couplers are used in an amount from 0.05 to 10mmol/m$^2$ and preferably from 0.1 to 5 mmol/m$^2$for each color.

Further, a colored coupler can be used for correcting unnecessary absorption of a color developing dye, a compound (including a coupler) which reacts with a developing agent oxidized product to release a photographically useful compound residue, for example, a developing inhibitor.

Hydrophobic additives such as a developing agent, a coupler and the like can be introduced into the above-described light-sensitive material layer by a known method described in U.S. Pat. No. 2,322,027. In this case, an organic solvent having a high boiling point as described in U.S. Pat. Nos. 4,555,470, 536,466, 4,536,467, 4,587,206, 4,555,476 and 4,599,296, Japanese Patent Application Publication (JP-B) No. 3-62,256 and the like can be used, if necessary, together with an organic solvent having a low boiling point from 50 to 160° C. The amount of the organic solvent having a high boiling point is 10 g or less, preferably 5 g or less and more preferably from 1 to 0.1 g for each 1 g of the hydrophobic additive used.

(Light-sensitive layer)

The light-sensitive material of the present invention is usually constituted from 3 or more light-sensitive layers having a different color sensitivity. Each light-sensitive layer contains at least one silver halide emulsion layer, and as a typical example, it is constituted from a plurality of silver halide emulsion layers having different light sensitivities though having substantially the same color sensitivity. This light-sensitive layer is a unit light-sensitive layer having color sensitivity in any of a blue light, green light and red light, and in a multi-layer silver halide color photographic light-sensitive material, unit light-sensitive layers, namely, a red color light-sensitive layer, a green color light-sensitive layer and a blue color light-sensitive layer are generally placed in this order from the substrate side. However, the reverse order formation, and a formation in which a different light-sensitive layer is sandwiched between the same light-sensitive layers, can also be adopted according to the object.

The total thickness of light-sensitive layers is from 1 to 20 μm, and preferably from 3 to 15 μm.

In the present invention, as a colored layer using an oil-soluble dye which can be decolorized by treatment, a yellow filter layer, magenta filter layer and cyan filter layer (anti-halation layer) can be used. By this, when a red color light-sensitive layer, a green color light-sensitive layer and a blue color light-sensitive layer are placed in this order from the substrate side, for example, a yellow filter layer can be provided between the blue color light-sensitive layer and the green color light-sensitive layer, a magenta filter layer can be provided between the green color light-sensitive layer and the red color light-sensitive layer and a cyan filter layer can be provided between the red color light-sensitive layer and the substrate. These colored layers may directly contact the silver halide emulsion layer, or may be placed so that they contact the emulsion layer via an intermediate layer such as gelatin and the like. The amounts used of the dyes are such that the transmission density of each layer against blue, green or red light is from 0.03 to 3.0 and more preferably from 0.1 to 1.0. Specifically, the amount is preferably from 0.005 to 2.0 mmol/m$^2$ and more preferably from 0.05 to 1.0 mmol/m$^2$although this differs depending on E and the molecular weight of the dye.

Preferable dyes are $(NC)_2C{=}C(CN){-}R_3$ ($R_3$ represents an aryl group, heterocyclic group), or compounds which comprise a methine group and two moiety selected from the following group i) to iv)

i) an acidic nucleus composed of a) cyclic ketomethylene compounds described in Japanese Patent Application No. 8-329,124 (for example, 2-pyrazoline-5-one, 1,2,3,6-tetrahydropyridine-2,6-dione, rhodanine, hydantoin, thiohydantoin, 2,4-oxazolidinedione, isooxazolone, barbituric acid, thiobarbituric acid, indanedione, dioxopyrazolipyridine, hydroxypyridine, pyrazolidinedione, 2,5-diydrofuran-2-one, pyrroline-2-one) or b) compounds having a methylene group sandwiched between electron attractive groups (for example, a methylene group sandwiched between —CN, $—SO_2R_1$, $—COR_1$, $—COOR_1$, $CON(R_2)_2$, $—SO_2N(R_2)_2$, $—C[=C(CN)_2]R_1$, or $—C[=C(CN)_2]N(R_1)_2$ (wherein $R_1$ represents an alkyl group; and alkenyl group, aryl group, cycloalkyl group or heterocyclic group, $R_2$ represents a hydrogen atom or a group as defined for $R_1$));

ii) a basic nucleus (for example, pyridine, quinoline, indolenine, oxazole, imidazole, thiazole, benzooxazole, benzimidazole, benzothiazole, oxazoline, naphthooxazole, or pyrrole);

iii) an aryl group (for example, phenyl group, or naphthyl group); and iv) a heterocyclic group (for example, pyrrole, indole, furan, thiophen, imidazole, pyrazole, indolidine, quinoline, carbazole, phenothiazine, phenozadine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, cumarin, or cumarone)

In the light-sensitive material of the present invention, two or more dyes may be mixed in one colored layer. For example, three dyes of yellow, magenta and cyan can also be mixed and used in the above-described anti-halation layer.

The dye is preferably a decolorizing dye which has been dissolved in an oil and/or oil-soluble polymer to obtain oil drops and these drops are dispersed in a hydrophilic binder for use. As a method for producing the same, an emulsifying dispersion method is preferable, and for example, is conducted according to a method described in U.S. Pat. No. 2,322,027. In this case, an oil having high boiling point as described in U.S. Pat. Nos. 4,555,470, 536,466, 4,587,206, 4,555,476 and 4,599,296, JP-B No. 3-62,256 and the like can be used, if necessary, together with an organic solvent having a low boiling point from 50 to 160° C. The oil having a high boiling point may be used in combinations of two or more. An oil-soluble polymer may be used instead of the oil or together with the oil, and examples thereof are described in WO 88/00723. The amount of the oil having a high boiling point and/or the polymer is from 0.01 to 10 g and preferably from 0.1 to 5 g based on 1 g of a dye used.

As the method for dissolving a dye into a polymer, a latex dispersion method may also be adopted, and specific examples of the process and latex used for immersion are described in publications such as U.S. Pat. No. 4,199,363, OLS Nos. 2,541,274, 2,541,230, JP-B No. 53-41091, EP-A No. 029104, and the like.

Various surfactants can be used when dispersing oil drops in the above-described hydrophilic binder. For example, those surfactants can be used as described in JP-A No. 59-157,636, pp. 37 to 38, Known Technology No. 5 (March 22, 1991, published by Aztec limited), pp. 136 to 138. Phosphate type surfactants described in JP-A Nos. 7-56,267 and 7-228,589, and OLS No. 932,299A can also be used.

As the hydrophilic binder, a water-soluble polymer is preferable. Examples include natural compounds such as gelatin, protein or cellulose derivative of gelatin derivative, starch, gum arabic, polysaccharides such as dextran, pullulan and the like, and synthetic polymer compounds such as polyvinyl alcohol, polyvinylpyrrolidone, acrylamide polymer and the like. These water-soluble polymers can also be used in combinations of two or more. In particular, a combination with gelatin is preferable. The gelatin may advantageously be selected from lime-processed gelatin, acid-processed gelatin, and so-called de-limed gelatin in which calcium content is reduced, according to various objects, or they may be used in combination.

The dye is decolorized in treatment in the presence of a decolorizing agent.

Examples of the decolorizing agent include alcohols or phenols, amines or anilines, sulfinic acids or salts thereof, sulfurous acid or salts thereof, thiosulfuric acid or salts thereof, carboxylic acids or salts thereof, hydrazines, guanidines, aminoguanidines, amidines, thiols, cyclic or linear active methylene compound, cyclic or linear active methine compound, and anions derived from these compounds.

Among these, preferably used are hydroxyamines, sulfinic acids, sulfurous acid, guanidines, aminoguanidines, heterocyclic thiols, cyclic or linear active methylene and active methine compounds, and particularly preferable are guanidines and aminoguanidines.

It is believed that the decolorizing agent decolorizes a dye by contacting with the dye in treatment and causing nucleophilic addition to the dye molecules. Preferably, a silver halide light-sensitive material containing a dye, after or simultaneously with image-wise exposure, is laminated with a treating member containing a decolorizing agent or a precursor of a decolorizing agent so that film surfaces thereof face each other in the presence of water and heated, then, they are released, to obtain a color-developed image on the silver halide light-sensitive material and to decolorize the dye. In this case, the concentration of the dye after decolorization is ⅓ or less and preferably ⅕ or less of the original concentration. The amount used of the decolorizing agent is from 0.1 to 200-fold mol and preferably from 0.5 to 100-fold mol of the dye.

(Other layers)

The light-sensitive silver halide, developing agent and coupler may be contained in the same light-sensitive layer or in separate layers. Further, a protective layer, primer layer and intermediate layer, and non-light-sensitive layers such as the yellow filter layer, anti-halation layer and the like, may also be provided in addition to the light-sensitive layer, and the rear surface of the substrate may carry a back layer. The thickness of the films coated on the light-sensitive layer is from 3 to 25 $\mu$m and preferably from 5 to 20 $\mu$m.

(Other components)

In the light-sensitive material of the present invention, a curing agent, surfactant, photograph stabilizing agent, antistatic agent, sliding agent, matting agent, latex, formalin scavenger, dye, UV absorber and the like can be used for various objects. Specific examples thereof are described in the above-described Research Disclosure and specifications such as Japanese Patent Application No. 8-30103 and the like. And, examples of particularly preferable antistatic agents include metal oxide fine particles such as ZnO, $TiO_2$, $SnO_2$, $Al_2O_3$, $In_2O_3$, $SiO_2$, MgO, BaO, $MoO_3$, $V_2O_5$ and the like.

(Substrate)

As the substrate of the light sensitive material, preferable photographic substrates are described in Nippon Shashin Gakkai ed. "Shashinkogaku no kiso (Fundamentals of Photographic Engineering)—Ginenshashin hen (Silver Salts Photography Section)—" published by Corona Corp. (1979), pp. 223 to 240. Specifically, polyethylene terephthalate, polyethylene naphthalate, polycarbonate, syndiotactic polystyrene, celluloses (for example, triacetylcellulose) and the like.

Among these, polyesters containing polyethylene naphthalate as a main component are particularly preferable, and the polyester "containing polyethylene naphthalate as a main component" is preferably a compound in which the content of naphthalene dicarboxylic acid contained in the total dicarboxylic acid residue is 50% or more. More preferably, it is 60 mol % or more and most preferably it is 70 mol % or more. It may be a copolymer or a polymer blend.

In the case of the copolymer, compounds obtained by copolymerization of units such as terephthalic acid, bisphenol A, cyclohexanedimethanol and the like in addition to the naphthalenedicarboxylic acid unit and ethylene glycol unit, are also preferable. Among these, a compound obtained by copolymerization of the terephthalic acid unit is most preferable in view of mechanical strength and cost.

As the preferable partner of the polymer blend, polyethylene terephthalate (PET), polyarylate (PAr), polycarbonate (PC), polycyclohexanedimethanol terephthalate (PCT) and the like are listed in view of compatibility. Among these, a polymer blend with PET is preferable in view of mechanical strength and cost.

Specific examples of the preferable polyesters are shown below.

Examples of a polyester copolymer (number in brackets indicates molar ratio)

2,6-naphthalenedicarboxylic acid/terephthalic acid/ethylene glycol (70/30/100) Tg=98° C.

2,6-naphthalenedicarboxylic acid/terephthalic acid/ethylene glycol (80/20/100) Tg=105° C.

Examples of polyester polymer blend (number in brackets indicates ratio by weight)

PEN/PET (60/40) Tg=95° C.

PEN/PET (80/20) Tg=104° C.

These substrates can be subjected to heat treatment (control of crystallinity and orientation), monoaxial and biaxial drawing (control of orientation), blend of various polymers, surface treatment, and the like, for improving optical property and physical property.

It is preferable to use a substrate having, for example, a magnetic recording layer as described in JP-A No. 4,124,645, 5-40,321, 6-35,092 and 6-31,875 and to record projection information and the like.

It is also preferable to apply a water-resistant polymer as described in JP-A No. 8-292,514 on the rear surface of the substrate of the light-sensitive material.

Details of polyester substrates particularly preferably used for a light-sensitive material having the magnetic recording layer are described in Technical Disclosure Bulletin No. 94-6023 (Japan Institute of Invention and Innovation; Mar. 15, 1994). The thickness of the substrate is from 5 to 200 μm and preferably from 40 to 120 μm.

(Treating member)

In the present invention, it is preferable to use a treating member comprising a substrate carrying thereon a treating layer containing at least a base and/or a precursor of a base, superpose the treating member on the light-sensitive material and heat them to develop a projected thermal developing color light-sensitive material. As the base, an inorganic or organic base can be used. The inorganic base may include hydroxides, phosphates, carbonates, organic acid salts of alkaline metals or alkaline earth metals described in JP-A No. 62-209448, acetylides of alkaline metals or alkaline earth metals described in JP-A No. 63-25208.

The organic base may include ammonia, aliphatic or aromatic amines (for example, primary amines, secondary amines, tertiary amines, polyamines, hydroxylamines, heterocyclic amines), amidines, bis- or tris- or tetra-amidines, guanidines, water-insoluble bis- or tris- or tetra-guanidines, hydroxides of quaternary ammonium, and the like.

As the precursor for a base, decarboxylation type, decomposing type, reacting type and complex salt forming type precursors can be used.

Examples of the base and the precursor of a base which can be preferably used in the present invention are described in "Known Technology" No. 5 (Mar. 22, 1991, published by Aztec Ltd. Co.), pp. 55 to 88.

The method for generating a base which can be most preferably used in the present invention is a method disclosed in EP 210,660 and U.S. Pat. No. 4,740,445 in which a base is generated by the combination of a basic metal compound which is poorly soluble in water with a compound which can effect a complex forming reaction with a metal ion contained in this basic metal compound by using water as a medium. In this case, it is preferable that the basic compound which is poorly soluble in water is added to the light-sensitive material, and the complex forming compound is added to the first treating member, however, the reverse combination is also possible. A preferable compound combination is obtained in a system in which fine particles of zinc hydroxide are used in the light-sensitive material and a salt of pocolinic acid, for example, guanidine picolinate is used in the first treating member.

In the first treating member, a mordanting agent may also be used, and in this case, a polymer mordanting agent is preferable. Further, in addition, it is preferable to use as a binder the water-soluble polymers such as gelatin and the like as described for the light-sensitive material.

The first treating member may further have a protective layer, primary layer, back layer and other auxiliary layers in addition to the treating layer. These layers are preferably cured with a curing agent. The curing agent used is the same as that for the light-sensitive material.

Regarding the first treating member, a method is preferable in which a treating layer is provided on a continuous web, fed from a feeding roll and used for treatment, then, wound onto another roll without being cut. For example, this method is described in JP-A No. 9-127670.

The substrate of the first treating member is not restricted, and the plastic films and paper as described for the light-sensitive material are used. The thickness of the substrate is from 4 to 120 μm and preferably from 6 to 70 μm.

A film obtained by the deposition of aluminum as described in JP-A No. 9-222,690 can be preferably used.

Further, it may also be possible for a second treating member containing a solvent for a silver halide to be used, the treatments conducted and, subsequently, the light-sensitive material and the second treating member superposed and heated. As the solvent for a silver halide, known solvents can be used. For example, thiosulfates, sulfites, thiocyanates, thio ether compounds described in JP-B No. 47-11,386, compounds having a 5- to 6-membered ring imide group such as uracil and hydantoin described in JP-A No. 8-179,458, compounds having a carbon-sulfur double bond described in JP-A No. 53-144,319, mesoion thiolate compounds such as trimethyltriazolium thiolate and the like described in Analytica Chimica Acta, vol 248, pp. 604 to 614, are preferably used. Further, there can be also used as the solvent for a silver halide a compound which fixes and stabilizes a silver halide described in JP-A No. 8-69,097. The most preferable is the mesoion thiolate compound.

The solvents for silver halide may be used alone or in combinations of two or more.

The total content of the solvents for the silver halide in the treating layer is from 0.01 to 100 mmol/$m^2$, and preferably from 0.1 to 50 mmol/$m^2$. This is from 1/20 to 20-fold, preferably from 1/10 to 10-fold, and more preferably from 1/4 to 4-fold in terms of molar ratio of the amount of silver applied to the light-sensitive material.

The solvent for a silver halide may be prepared in a solution with a solvent such as water, methanol, ethanol, acetone, dimethylformamide, methylpropylene glycol and the like or an acidic aqueous solution and added, or may be dispersed with a solid fine particle and the resulting dispersion may be added to the coating liquid.

The second treating member may further have a protective layer, primary layer, back layer and other auxiliary layers in addition to the treating layer.

These layers are preferably cured with a curing agent. The curing agent used is the same as that for the light-sensitive material.

The substrate preferably used for the second treating member is the same as that for the first treating member.

The method preferred for the second treating member is like that for the first treating member, in which a treating layer is provided on a continuous web, fed from a feeding roll and used for treatment, then, wound onto another roll without being cut.

(Image formation)

As an actual image formation example of the present invention, the light-sensitive material is processed so that it can be used in a normal 135 camera, APS camera or film equipped with a lens, and loaded in a cartridge. The light-sensitive material having been photographed using a camera is drawn out from the cartridge, the first treating member is used first, and the light-sensitive material is heated and developed with water present between the light-sensitive layer and the treating member. When the amount of water is too little, the development does not progress. On the other hand, when it is too great, there occur problems such as water overflowing from the film surface, drying after releasing taking a longer time, and the like. This amount of water is preferably from 10% to 100% of that required for maximum swelling of the all coated films excepting the back layers of the light-sensitive material and the first treating member, and specifically, an amount from 1 to 50 cc/$m^2$ is preferable. In the presence of this amount of water, the light-sensitive material and the treating member are superposed so that the light-sensitive layer and the treating layer face each other and they are heated at a temperature from 60 to 100° C. for 5 to 60 seconds.

As the method for imparting water, there is a method in which the light-sensitive material or treating member is immersed in water, and excess water is removed by a squeeze roller. A method as described in JP-A No. 10-26,817 is also preferable in which water is sprayed by a water applying apparatus comprising a nozzle in which a plurality of nozzle holes for spraying water are arranged at regular intervals in straight line in a direction perpendicular to the direction in which the light-sensitive material or treating member is transported, and an actuator which displaces the nozzles toward the light-sensitive material or treating member which are on the transportation route.

Further, a method in which water is applied by sponge and the like is also preferable.

As the heating method, the light-sensitive material may be contacted with a heated block or plate, or a heat roller, heat drum, infrared and far infrared lamp may also be used for the heating.

After the first treatment, the light-sensitive material is released from the first treating member, then the second treatment is conducted using the second treating member. The amount of water applied is from 1 to 50 cc/$m^2$, and the heating is conducted at 40 to 100° C. for 2 to 60 seconds.

After the second treatment, the light-sensitive member is released from the second treating member, and dried to obtain a stabilized image on the light-sensitive material. Furthermore, it is also possible to wash the light-sensitive material with water before drying.

As the preferable embodiment of the present invention, an image is obtained on the light-sensitive material, then, a color image is obtained on other recording material based on the image information. As this method, a light-sensitive material such as color paper may be used and a color image may be obtained by normal projection exposure, however, it is preferable that the image information is read photoelectrically by measurement of the concentration of a transmitted light, converted into digital signals, and the digital signals are output on other recording materials such as a thermal developing light-sensitive material and the like after image treatment. As the material on which output is conducted, a sublimation type heat-sensitive recording material, a fullcolor direct heat-sensitive recording material, an ink jet material, an electrophotographic material and the like may also be allowable in addition to a light-sensitive material using a silver halide.

It is also possible to load a light-sensitive material after use into the same or different cartridge from the original one and to store it.

EXAMPLES

The following examples further illustrate the present invention but do not limit the scope thereof.

<Preparation of light-sensitive silver halide emulsion>

A preparation method for a blue color light-sensitive silver halide emulsion (1) is described below.

Into a reaction vessel was charged 1191 ml of distilled water containing 0.96 g of gelatin having an average molecular weight of 12,000 and 0.9 g of potassium bromide, and the solution was heated up to 40° C. To this solution were added 10.5 ml of an aqueous solution (A) containing 0.5 g of sodium nitrate silver and 10 ml of an aqueous solution (B) containing 0.35 g of potassium bromide over 150 seconds with vigorous stirring. 30 seconds after completion of the addition, 12 ml of 10% aqueous potassium bromide solution was added, and after 30 seconds, the temperature of the reaction solution was raised to 75° C. To this were added 35.0 g of a lime-processed gelatin and 250 ml of distilled water, then, 39 ml of an aqueous solution (C) containing 10.0 g of silver nitrate and 30 ml of an aqueous solution (D) containing 6.7 g of potassium bromide were added while the addition flow rate was accelerated over 3 minutes and 15 seconds. Then, 302 ml of an aqueous solution (E) containing 96.7 g of silver nitrate and an aqueous solution (F) containing potassium iodide and potassium bromide at a molar ratio of 7:93 (KI: KBr, concentration of potassium bromide: 26%) were added while the addition flow rate was accelerated and while the silver electric potential of the reaction solution was controlled at −20 mV with reference to a saturated calomel electrode over 20 minutes.

Further, 97 ml of an aqueous solution (G) containing 24.1 g of silver nitrate and a 21.9% aqueous solution of potassium bromide (H) were added while the silver electric potential of the reaction solution was controlled at 25 mV relative to a saturated calomel electrode over 3 minutes. After completion of the addition, the solution was kept at 75° C. for one minute, then, the temperature of the reaction solution was lowered to 55° C. Then, 15 ml of 1 N sodium hydroxide was added. After two minutes, 100 ml of an aqueous solution (I) containing 5 g of silver nitrate and 200.5 ml of an aqueous solution (J) containing 4.7 g of potassium iodide were added over 5 minutes. After completion of the addition, 7.11 g of potassium bromide was added, and the solution was kept at 55° C. for one minute, then, 248 ml of an aqueous solution (K) containing 62 g of silver nitrate and 231 ml of an aqueous solution (L) containing 48.1 g of potassium bromide were further added over 8 minutes. After 30 seconds, an aqueous solution containing 0.03 g of sodium ethylthiosulfonate was added. The temperature was lowered, and desalting was conducted by flocculating and precipitating emulsion particles using Demol manufactured by Kao Corp. Dispersion was conducted by adding sodium benzenethiosulfonate, phenoxyethanol, water-soluble polymer (10) and lime-processed gelatin.

Chemical sensitization was conducted at a temperature of 60° C. A sensitizing dye (12) was added in the form of a gelatin dispersion before chemical sensitization, then, a mixed solution of potassium thiocyanate and aurate chloride was added, then, sodium thiosulfate and a selenium sensitizing agent were added, and stopping of the chemical sensitization was conducted with a mercapto compound. The amounts of the sensitizing dye, chemical sensitizing agent and mercapto compound were controlled to optimum values depending on sensitivity and fogging.

In the resulting particles, tabular particles occupied a proportion of over 99% of the total projection area of the total particles, and the average size in terms of sphere diameter was 1.07 μm, the average thickness was 0.38 μm, the equivalent circle diameter was 1.47 μm and the average aspect ratio was 3.9.

Sensitizing dye (12)

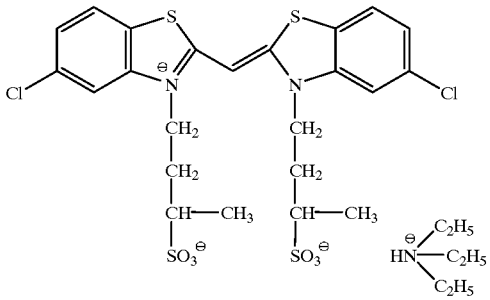

Water-soluble polymer (10)

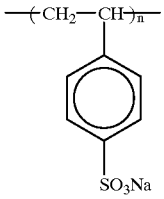

Selenium sensitizing agent

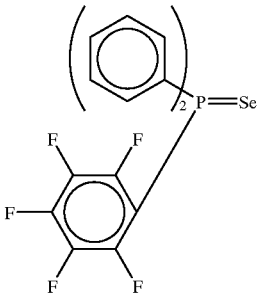

Mercapto compound

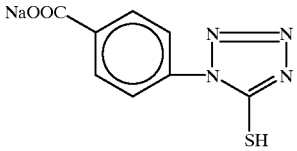

A preparation method for a blue color light-sensitive silver halide emulsion (2) is described below.

Into a reaction vessel was charged 1191 ml of distilled water containing 0.96 g of gelatin having an average molecular weight of 12,000 and 0.9 g of potassium bromide, and the solution was heated up to 40° C. To this solution were added 37.5 ml of an aqueous solution (A) containing 1.5 g of nitrate silver and 37.5 ml of an aqueous solution (B) containing 1.051 g of potassium bromide over 90 seconds with vigorous stirring. 30 seconds after completion of the addition, 12 ml of 10% aqueous potassium bromide solution was added, and after 30 seconds, the temperature of the reaction solution was raised to 75° C. To this were added 35.0 g of a lime-processed gelatin and 250 ml of distilled water, then, 116 ml of an aqueous solution (C) containing 29.0 g of silver nitrate and 91 ml of an aqueous solution (D) containing 20 g of potassium bromide were added while the addition flow rate was accelerated over 11 minutes and 35 seconds. Then, 302 ml of an aqueous solution (E) containing 96.7 g of silver nitrate and an aqueous solution (F) containing potassium iodide and potassium bromide at a molar ratio of 3.3:96.7 (KI: KBr, concentration of potassium bromide: 26%) were added while the addition flow rate was accelerated and while the silver electric potential of the reaction solution was controlled at 2 mV with reference to a saturated calomel electrode over 20 minutes.

Further, 97 ml of an aqueous solution (G) containing 24.1 g of silver nitrate and a 21.9% aqueous solution of potassium bromide (H) were added while the silver electric potential of the reaction solution was controlled at 0 mV with reference to a saturated calomel electrode over 3 minutes. After completion of the addition, the solution was kept at 75° C. for one minute, then, the temperature of the reaction solution was lowered to 55° C. Then, 15 ml of 1 N sodium hydroxide was added. After two minutes, 153 ml of an aqueous solution (I) containing 10.4 g of silver nitrate and 414.5 ml of an aqueous solution (J) containing 9.35 g of potassium iodide were added over 5 minutes. After completion of the addition, 7.11 g of potassium bromide was added, and the solution was kept at 55° C. for one minute, then, 228 ml of an aqueous solution (K) containing 57.1 g of silver nitrate and 201 ml of an aqueous solution (L) containing 43.9 g of potassium bromide were further added over 8 minutes. After 30 seconds, an aqueous solution containing 0.04 g of sodium ethylthiosulfonate was added. The temperature was lowered, and desalting was conducted in the same manner as for the blue color light-sensitive silver halide emulsion (1). The chemical sensitization was conducted in the same manner except that the blue color light-sensitive silver halide emulsion (1) and selenium sensitizing agent were not added. The sensitizing dye and mercapto compound used for stopping the chemical sensitization were approximately in proportion to the surface area of the emulsion particle.

In the particles in the resulting emulsion, tabular particles occupied a proportion of over 99% of the total projection area of the total particles, and the average size in terms of sphere diameter was 0.66 pm, the average thickness was 0.17 μm, the average equivalent circle diameter was 1.05 μm and the average aspect ratio was 6.3.

A preparation method for a blue color light-sensitive silver halide emulsion (3) is described below.

Into a reaction vessel was charged 1345 ml of distilled water containing 17.8 g of lime-processed gelatin, 6.2 g of potassium bromide and 0.46 g of potassium iodide, and the solution was heated up to 45° C. To this solution were added 70 ml of an aqueous solution (A) containing 11.8 g of nitrate silver and 70 ml of an aqueous solution (B) containing 3.8 g of potassium bromide over 45 seconds with vigorous stirring. After keeping the temperature at 45° C. for 4 minutes, the temperature of the reaction solution was raised to 63° C. To this were added 24 g of a lime-processed gelatin and 185 ml of distilled water, then, 208 ml of an aqueous solution (C) containing 73 g of silver nitrate and a 24.8% aqueous solution of potassium bromide (D) were added while the addition flow rate was accelerated and while the silver electric potential of the reaction solution was controlled at 0 mV with reference to a saturated calomel electrode over 13 minutes. After completion of the addition, the temperature of the solution was kept at 63° C. for 2 minutes, then the temperature was lowered to 45° C.

Then, 15 ml of 1N sodium hydroxide solution was added. After 2 minutes, 60 ml of an aqueous solution (E) containing 8.4 g of silver nitrate and 461 ml of an aqueous solution (F) containing 8.3 g of potassium were added over 5 minutes. Further, 496 ml of an aqueous solution (G) containing 148.8 g of silver nitrate and a 25% aqueous solution of potassium bromide (H) were added while the silver electric potential of the reaction solution was controlled at 90 mV with reference to a saturated calomel electrode over 47 minutes. 30 seconds after completion of the addition, an aqueous solution containing 2 g of potassium bromide and 0.06 g of sodium ethylthiosulfonate was added. The temperature was lowered, and the desalting, dispersion and chemical sensitization were conducted in the same manner as for the blue color light-sensitive silver halide emulsion (2). The particles in the resulting emulsion were hexagonal, tabular particles in which the average particle represented in terms of the diameter of a corresponding sphere was 0.44 μm, the average thickness was 0.2 μm, the average equivalent circle diameter was 0.53 μm and the average aspect ratio was 2.6.

A preparation method for a green color light-sensitive silver halide emulsion (4) is described below.

Into a reaction vessel was charged 1191 ml of distilled water containing 0.96 g of gelatin having an average molecular weight of 12,000 and 0.9 g of potassium bromide, and the solution was heated up to 40° C. To this solution were added 17.5 ml of an aqueous solution (A) containing 0.7 g of nitrate silver and 17.5 ml of an aqueous solution (B) containing 1.051 g of potassium bromide over 120 seconds with vigorous stirring. 30 seconds after completion of the addition, 12 ml of 10% aqueous potassium bromide solution was added, and after 30 seconds, the temperature of the reaction solution was raised to 75° C. To this was added 35.0 g of a lime-processed gelatin together with 250 ml of distilled water, then, 56 ml of an aqueous solution (C) containing 19.0 g of silver nitrate and 461 ml of an aqueous solution (D) containing 10 g of potassium bromide were added while the addition flow rate was accelerated over 7 minutes and 35 seconds. Then, 302 ml of an aqueous solution (E) containing 96.7 g of silver nitrate and an aqueous solution (F) containing potassium iodide and potassium bromide at a molar ratio of 3.3:96.7 (KI: KBr, concentration of potassium bromide: 26%) were added while the addition flow rate was accelerated and while the silver electric potential of the reaction solution was controlled at 0 mV with reference to a saturated calomel electrode over 20 minutes.

Further, 97 ml of an aqueous solution (G) containing 24.1 g of silver nitrate and a 21.9% aqueous solution of potassium bromide (H) were added while the silver electric potential of the reaction solution was controlled at 0 mV with reference to a saturated calomel electrode over 3 minutes. After completion of the addition, the solution was kept at 75° C. for one minute, then, the temperature of the reaction solution was lowered to 55° C. Then, 122 ml of an aqueous solution (I) containing 8.3 g of silver nitrate and 332 ml of an aqueous solution (J) containing 7.48 g of potassium iodide were added over 5 minutes. After completion of the addition, 7.11 g of potassium bromide was added, and the solution was kept at 55° C. for one minute, then, 228 ml of an aqueous solution (K) containing 62.8 g of silver nitrate and 201 ml of an aqueous solution (L) containing 48.3 g of potassium bromide were further added over 8 minutes. The temperature was lowered, and desalting and dispersion were conducted in the same manner as for the blue color light-sensitive silver halide emulsion (1). The chemical sensitization was also conducted in the same manner as for the blue color light-sensitive silver halide emulsion (1) except that a gelatin dispersion of a mixture of sensitizing dyes (13), (14) and (15) was added instead of sensitizing dye (12).

In the particles in the resulting emulsion, tabular particles occupied a proportion of over 99% of the total projection area of the total particles, and the average size in terms of sphere diameter was 0.85 μm, the average thickness was 0.26 μm, the average equivalent circle diameter was 1.25 μm and the average aspect ratio was 4.8.

Sensitizing dye for green sensitive emulsion (13)

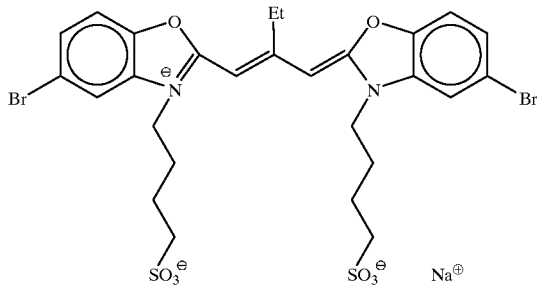

Sensitizing dye for green sensitive emulsion (14)

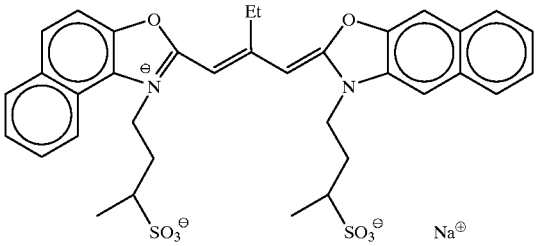

Sensitizing dye for green sensitive emulsion (15)

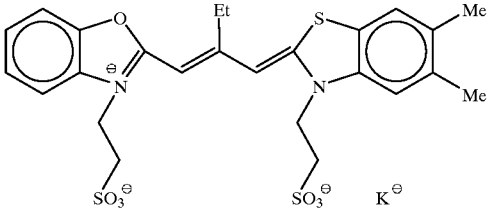

A preparation method for a green color light-sensitive silver halide emulsion (5) is described below.

The desalting and dispersion were conducted in the same manners as for the blue color light-sensitive silver halide emulsion except that sodium hydroxide and sodium ethylthiosulfonate were not added in the particle formation, and the chemical sensitization was conducted in the same manner as for the green color light-sensitive silver halide emulsion (4).

In the particles in the resulting emulsion, tabular particles occupied a proportion of over 99% of the total projection area of the total particles, and the average size in terms of sphere diameter was 0.66 μm, the average thickness was 0.17 μm, the average equivalent circle diameter was 1.05 μm and the average aspect ratio was 6.3.

A preparation method for a green color light-sensitive silver halide emulsion (6) is described below.

The particle formation, desalting and dispersion were conducted in the same manner as for the blue color light-sensitive silver halide emulsion (3) except that sodium hydroxide was not added in the particle formation and the amount of sodium ethylthiosulfonate was changed to 4 mg, and an emulsion was prepared in the same manner as for the green color light-sensitive silver halide emulsion (4) except that no selenium sensitizing agent was added in the chemical sensitization.

The particles in the resulted emulsion were hexagonal, tabular particles in which the average particle represented in terms of diameter of corresponding sphere was 0.44 μm, the average thickness was 0.2 μm, the average equivalent circle diameter was 0.53 μm and the average aspect ratio was 2.6.

A preparation method for a red color light-sensitive silver halide emulsion (7) is described below.

An emulsion was prepared in the same manner as for the green color light-sensitive silver halide emulsion (4) except that a gelatin dispersion of a sensitizing dye (16) and a gelatin dispersion of a mixture of sensitizing dyes (17) and (18) were added as the sensitizing dye in the chemical sensitization. In the resulting particles, tabular particles occupied a proportion of over 99% of the total projection area of the total particles, and the average size in terms of sphere diameter was 0.85 μm, the average thickness was 0.26 μm, the average equivalent circle diameter was 1.25 μm and the average aspect ratio was 4.8.

Sensitizing dye for red sensitive emulsion (16)

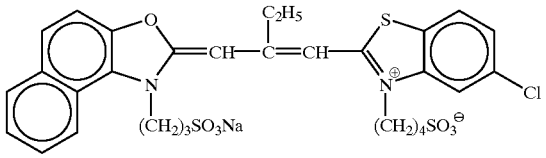

Sensitizing dye for red sensitive emulsion (17)

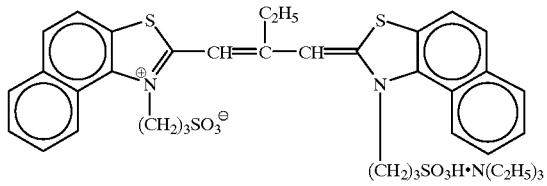

Sensitizing dye for red sensitive emulsion (18)

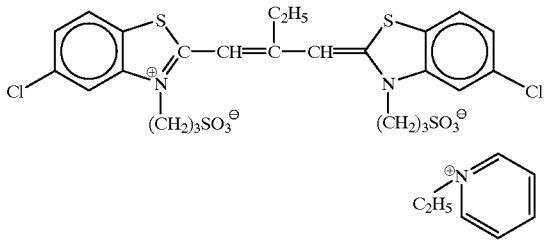

A preparation method for a red color light-sensitive silver halide emulsion (8) is described below.

An emulsion was prepared in the same manner as for the green color light-sensitive silver halide emulsion (5) except that a gelatin dispersion of a sensitizing dye (16) and a gelatin dispersion of a mixture of sensitizing dyes (17) and (18) were added as the sensitizing dye in the chemical sensitization.

In the resulting particles, tabular particles occupied a proportion of over 99% of the total projection area of the total particles, and the average size in terms of sphere diameter was 0.66 μm, the average thickness was 0.17 μm, the average equivalent circle diameter was 1.05 μm and the average aspect ratio was 6.3.

A preparation method for a red color light-sensitive silver halide emulsion (9) is described below.

An emulsion was prepared in the same manner as for the green color light-sensitive silver halide emulsion (6) except that a gelatin dispersion of a sensitizing dye (16) and a gelatin dispersion of a mixture of sensitizing dyes (17) and (18) were added as the sensitizing dye in the chemical sensitization.

The particles in the resulting emulsion were hexagonal, tabular particles in which the average particle represented in terms of diameter of corresponding sphere was 0.44 μm, the average thickness was 0.2 μm, the average equivalent circle diameter was 0.53 μm and the average aspect ratio was 2.6.

<Preparation of zinc hydroxide dispersion>

A powder of zinc hydroxide (31 g) having primary particles of a particle size of 0.2 μm, 1.6 g of carboxymethylcellulose and 0.4 g of sodium polyacrylate as a dispersing agent, 8.5 g of lime-processed osein gelatin and 158.5ml of water were mixed, and this mixture was dispersed for 1 hour with a mill using glass beads. After the dispersion, the glass beads were separated by filtration to obtain 188 g of a dispersion of zinc hydroxide.

<Preparation of emulsified dispersion of color developing agent and coupler>

Oil phase components whose composition is shown in the following Table 1 and aqueous phase components were respectively dissolved, to obtain uniform solutions of 60° C. The oil phase components and aqueous phase components were combined, and dispersed for 20 minutes at 10,000 rpm by a dissolver equipped with a disperser having a diameter of 5 cm in 1 liter stainless vessel. To this was added hot water in an amount shown in Table 1 as water added later, and mixed for 10 minutes at 2,000 rpm. In this manner, emulsified dispersions of three couplers of cyan, magenta and yellow were prepared.

TABLE 1

| | | Cyan | Magenta | Yellow |
|---|---|---|---|---|
| Oil phase | Cyan dye forming coupler C-1 | 3.58 g | — | — |
| | Magenta dye forming coupler M-1 | — | 2.63 g | — |
| | Yellow dye forming coupler Y-1 | — | — | 3.01 g |
| | Developing agent I-19 | 1.49 g | 2.25 g | — |
| | Developing agent I-3 | 0.73 g | — | — |
| | Developing agent II-22 | — | — | 2.42 g |
| | Tricresyl phosphate | 2.75 g | 2.5 g | 3.83 g |
| | Ethyl acetate | 6 ml | 6 ml | 6 ml |
| | Cyclohexanone | 6 ml | 6 ml | 6 ml |
| Water phase | Lime-processed gelatin | 4 g | 4 g | 4 g |
| | Sodium dodecylbenzenesulfonate | 0.27 g | 0.27 g | 0.27 g |
| | Water | 53 ml | 53 ml | 53 ml |
| | Water added later | 28 ml | 30 ml | 29 ml |

Cyan dye forming coupler C-1

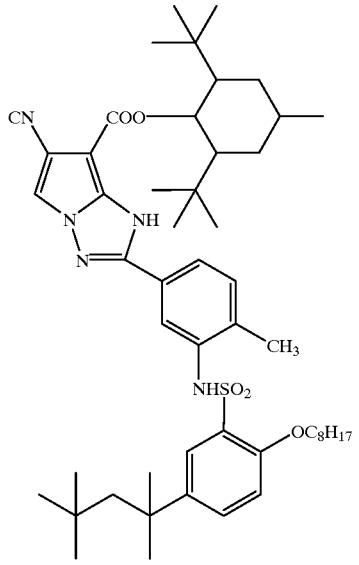

Magenta dye forming coupler M-1

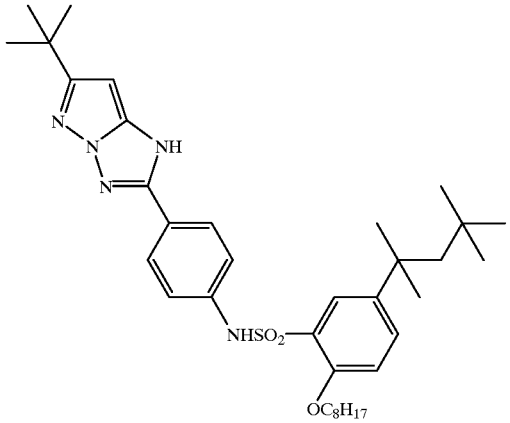

Yellow dye forming coupler Y-1

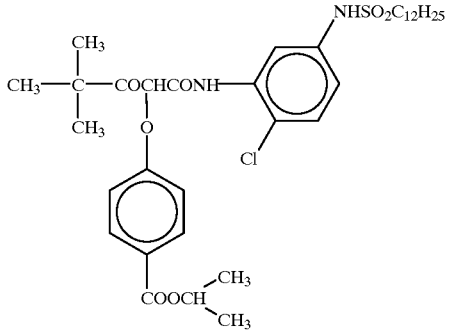

<Preparation of dye composition for yellow filter, magenta filter, and anti-halation layers>

A dye composition was prepared as an emulsified dispersion as described below and added.

7.1 g of a yellow dye (YF-1) was dissolved in 6.6 g of tricresyl phosphate, 30 cc of ethyl acetate and 30 cc of cyclohexanone, and the resulting solution was added to 135 g of a 7.8% gelatin aqueous solution containing 0.75 g of sodium dodecylbenzenesulfonate, and the mixture was stirred for 20 minutes at 10,000 rpm using a dissolver stirrer to be emulsified and dissolved. After the dispersion, distilled water was added until the solution was 260 g in total, and the mixture was mixed for 10 minutes at 2,000 rpm, to prepare a dye dispersion for a yellow filter layer.

A dye dispersion for a magenta filter layer was prepared in the same manner except that the dye was changed to 6.1 g of a magenta dye (MF-1).

A dye dispersion for an anti-halation layer was prepared in the same manner except that the dye was changed to 8.9 g of a cyan dye (CF-1).

YF-1

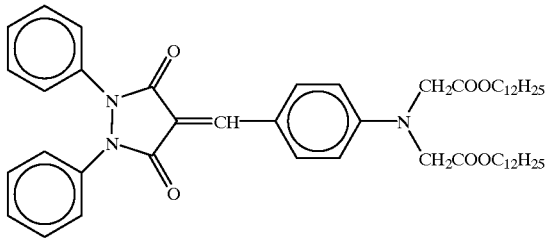

MF-1

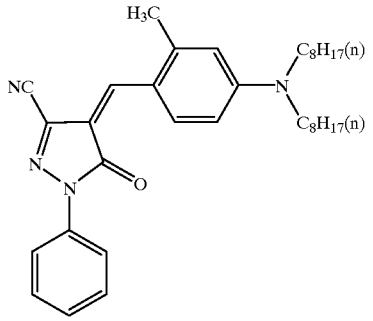

CF-1

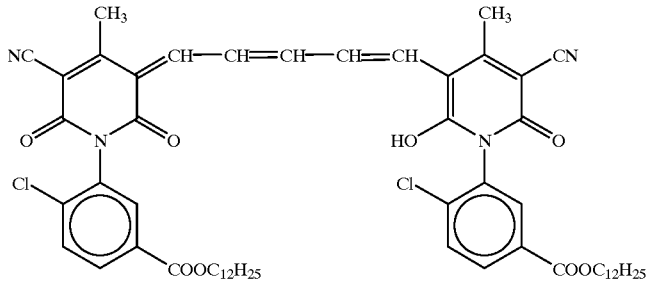

<Preparation of substrate>

Next, a substrate used in the present invention was prepared in the method described below.

Polyethylene-2,6-naphthalate (PEN) polymer (100 parts by weight) and 2 parts by weight of Tinuvin P.326 (manufactured by Ciba Geigy Corp.) as an ultraviolet ray absorber were dried, melted at 300° C., then extruded from a T die, and 3.3-magnified longitudinal drawing was conducted at 140° C., subsequently, 3.3-magnified transversal drawing was conducted at 130° C., and the product was thermally fixed for 6 seconds at 250° C. to obtain a PEN film having a thickness of 92 $\mu$m. To this PEN film were added a blue dye, magenta dye and yellow dye (laid-open technical publication: No. 94-6023, I-1, I-4, I-6, I-24, I-26, I-27 or II-5) so that the yellow concentration was 0.01, the magenta concentration was 0.08 and the cyan concentration was 0.09. This film was further wound on stainless core having a diameter of 20 cm and subjected to heat treatment at 113° C. for 30 hours, to give a substrate which was not easily curled.

<Coating of primer layer>

The above-described substrate was subjected to corona discharge treatment on both sides, UV irradiation treatment and glow discharge treatment, then a primer solution composed of gelatin (0.1 g/m$^2$), sodium a-sulfo-di-2-ethylhexylsuccinate (0.01 g/m$^2$), salicylic acid (0.025 g/m$^2$), PQ-1 (0.005 g/m$^2$) and PQ-2 (0.006 g/m$^2$) was coated on respective surfaces (10 cc/m$^2$ using a bar coater), making a primer layer on the surface which had the higher temperature during drawing. Drying was conducted at 115° C. for 6 minutes (rollers and transporting apparatuses in the drying zone were all maintained at a temperature of 115° C.).

<Coating of backing layer>

—Coating of antistatic layer—

A dispersion of fine particle powder having a specific resistivity of 5 Ω·cm of a tin oxide-antimony oxide complex having an average particle size of 0.005 $\mu$m (secondary flocculated particle size about 0.08 $\mu$m; 0.027 g/m$^2$), gelatin (0.03 g/m$^2$), $(CH_2{=}CHSO_2CH_2CH_2NHCO)_2CH_2$ (0.02 g/m$^2$), polyoxyethylene(polymerization degree: 10)-p-nonylphenol (0.005 g/m$^2$), PQ-3 (0.008 g/m$^2$) and resorcin were coated.

—Coating of magnetic recording layer—

Cobalt-γ-iron oxide (0.06 g/m$^2$) (specific surface area: 43 m$^2$/g, long axis: 0.14 $\mu$m, short axis: 0.03 $\mu$m, saturated magnetization: 89 emu/g, $Fe^{+2}/Fe^{+3}$=%94, surface had been treated with 2% by weight of aluminum oxide silicon oxide based on iron oxide) coated with 3-poly(polymerization degree 15)oxyethylene-propyloxytrimethoxysilane (15% by weight ) was coated by a bar coater using 1.15 g/m$^2$ of diacetylcellulose (dispersion of iron oxide was conducted by an open kneader and sand mill), PQ-4 (0.075 g/m$^2$) and PQ-5 (0.004 g/m$^2$) as a curing agent, and acetone, methyl ethyl ketone, cyclohexanone and dibutylphthalate as a solvent, to obtain a magnetic recording layer having a thickness of 1.2 $\mu$m. $C_6H_{13}CH(OH)C_{10}H_{20}COOC_{40}H_{81}$ (50 g/m$^2$) as a sliding agent, silica particles (average particle size 1.0 $\mu$m) as a matting agent and aluminum oxide (ERC-DBM manufactured by Reynolds Metal Corp; average particle size: 0.44 μm) as an abrasion agent were added respectively to give concentrations of 5 mg/$m_2$ and 15 mg/$m_2$. Drying was conducted at 115° C. for 6 minutes (rollers and transporting apparatuses in the drying zone were all maintained at a temperature of 115° C.). Color density increase of DB in the magnetic recording layer by X-light (blue filter) was about 0.1, saturated magnetization moment of the magnetic recording layer was 4.2 emu/g, coersive force was $7.3\times10^4$ A/m, and squareness was 65%.

—Coating of sliding layer—

Hydroxyethylcellulose (25 Mg/$m^2$), PQ-6 (7.5 mg/$m^2$), PQ-7 (1.5 mg/$m^2$) and polydimethylsiloxane (1.5 mg/$m^2$) were coated. This mixture was melted at 105° C. in xylene/propylene glycol monomethyl ether (1/1), poured for dispersion into propylene glycol monomethyl ether (10-fold volume) at normal temperature, then made into a dispersion (average particle size 0.01 μm) in acetone and added. Drying was conducted at 115° C. for 6 minutes (rollers and transporting apparatuses in the drying zone were all maintained at a temperature of 115° C.). The sliding layer had excellent properties such as a dynamic friction coefficient (5 mmϕ stainless hard sphere, load 100 g, speed 6 cm/minute) of 0.10, a static friction coefficient (clip method) of 0.09, and a dynamic friction coefficient between the emulsion surface and sliding layer of 0.18.

Light-sensitive members 101 each having the multilayer structure shown in the following Table 2 were made using the above materials and base.

Further, a first treating member R-1 having the content shown in the following Table 3 and a second treating member R-2 having the content shown in the following Table 4 were prepared.

TABLE 2

| Layer structure | Main material | Amount coated ($g/m^2$) |
|---|---|---|
| 13th layer | Gelatin | 0.89 |
| Protective layer | matting agent (silica) | 0.02 |
| 12th layer | Gelatin | 0.76 |
| Intermediate layer | Zinc hydroxide | 0.34 |
| 11th layer | Gelatin | 0.86 |
| Yellow color developing layer | Silver halide emulsion (1) | 0.50 (Amount of silver) |
| (High sensitivity layer) | Yellow dye forming coupler (Y-1) | 0.29 |
| | Developing agent (II-22) | 0.23 |
| | Tricresyl phosphate | 0.36 |
| 10th layer | Gelatin | 1.44 |
| Yellow color developing layer | Silver halide emulsion (2) | 0.25 (Amount of silver) |

PQ-1

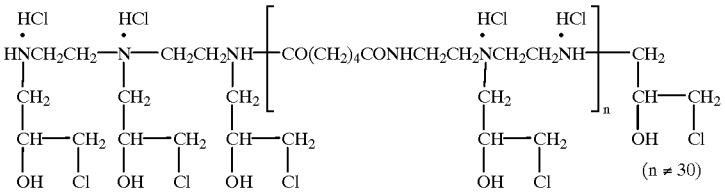

PQ-2

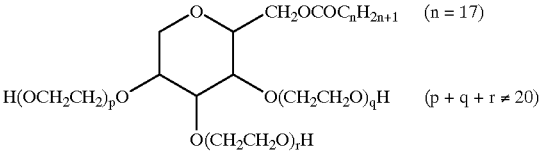

PQ-3

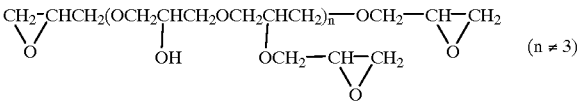

PQ-4

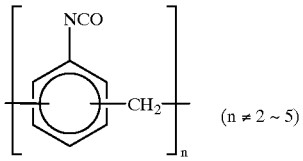

PQ-5

$(CH_3O)_3SiCH_2CH_2CH_2O(CH_2CH_2O)_nCH_3$ (n ≠ 7.3)

PQ-6

$C_{50}H_{101}(CH_2CH_2O)_nH$ (n ≠ 16)

PQ-7

$C_8F_{17}SO_2N(C_3H_7)(CH_2CH_2O)_n(CH_2)_4SO_3Na$ (n ≠ 4)

TABLE 2-continued

| Layer structure | Main material | Amount coated ($g/m^2$) |
|---|---|---|
| (Low sensitivity layer) | Silver halide emulsion (3) | 0.25 (Amount of silver) |
| | Yellow dye forming coupler (Y-1) | 0.45 |
| | Developing agent (II-22) | 0.36 |
| | Tricresyl phosphate | 0.56 |
| 9th layer | Gelatin | 0.21 |
| Intermediate layer | Yellow dye YF-1 | 0.14 |
| Yellow filter layer | Tricresyl phosphate | 0.13 |
| 8th layer | Gelatin | 0.43 |
| Magenta color developing layer | Silver halide emulsion (4) | 0.55 (Amount of silver) |
| (High sensitivity layer) | Magenta dye forming coupler (M-1) | 0.04 |
| | Developing agent (I-19) | 0.03 |
| | Tricresyl phosphate | 0.04 |
| 7th layer | Gelatin | 0.5 |
| Magenta color developing layer | Silver halide emulsion (5) | 0.35 (Amount of silver) |
| (Intermediate layer) | Magenta dye forming coupler (M-1) | 0.07 |
| | Developing agent (I-19) | 0.06 |
| | Tricresyl phosphate | 0.07 |
| 6th layer | Gelatin | 0.52 |
| Magenta color developing layer | Silver halide emulsion (6) | 0.34 (Amount of silver) |
| (Low sensitivity layer) | Magenta dye forming coupler (M-1) | 0.19 |
| | Developing agent (I-19) | 0.16 |
| | Tricresyl phosphate | 0.18 |
| 5th layer | Gelatin | 1.15 |
| Intermediate layer | Magenta dye MF-1 | 0.1 |
| Magenta filter layer | Zinc hydroxide | 2.03 |
| | Tricresyl phosphate | 0.1 |
| 4th layer | Gelatin | 0.96 |
| Cyan color developing layer | Silver halide emulsion (7) | 1.05 (Amount of silver) |
| (High sensitivity layer) | Cyan dye forming coupler (C-1) | 0.07 |
| | Developing agent (I-19) | 0.03 |
| | Developing agent (I-3) | 0.014 |
| | Tricresyl phosphate | 0.05 |
| Third layer | Gelatin | 0.24 |
| Cyan color developing layer | Silver halide emulsion (8) | 0.27 (Amount of silver) |
| (Intermediate layer) | Cyan dye forming coupler (C-1) | 0.054 |
| | Developing agent (I-19) | 0.022 |
| | Developing agent (I-3) | 0.011 |
| | Tricresyl phosphate | 0.04 |
| Second layer | Gelatin | 0.73 |
| Cyan color developing layer | Silver halide emulsion (9) | 0.55 (Amount of silver) |
| (Lower sensitivity layer) | Cyan dye forming coupler (C-1) | 0.32 |
| | Developing agent (I-19) | 0.13 |
| | Developing agent (I-3) | 0.065 |
| | Tricresyl phosphate | 0.25 |
| First layer | Gelatin | 0.24 |
| Anti-halation layer | Cyan dye CF-1 | 0.2 |
| | Tricresyl phosphate | 0.15 |
| | Primer layer | |
| | 92 $\mu$m PEN base | |
| | Primer layer | |
| | Antistatic layer | |
| | Magnetic recording layer | |
| | Sliding layer | |

Note: The layers on the base (i.e., layers from the primer layer to the 13th layer) were cured by 0.1 $g/m^2$ of a curing agent (H-1).

H-1 $CH_2{=}CH{-}SO_2{-}CH_2{-}SO_2{-}CH{=}CH_2$

TABLE 3

| Layer structure | Main material | Amount coated ($g/m^2$) |
|---|---|---|
| 4th layer | Gelatin | 0.22 |
| | κ-carageenan | 0.06 |
| | Silicon oil | 0.02 |
| | Matting agent (PMMA) | 0.4 |
| Third layer | Gelatin | 0.24 |
| | Curing agent (H-2) | 0.18 |
| Second layer | Gelatin | 2.41 |
| | Dextran | 1.31 |
| | Mordanting agent (P-1) | 2.44 |
| | Guanidine picolinate | 5.82 |
| | Potassium quinolinate | 0.45 |
| | Sodium quinolinate | 0.36 |
| First layer | Gelatin | 0.19 |
| | Curing agent (H-2) | 0.18 |
| | Primer layer | |
| | 63 $\mu$m PET base | |

H-2

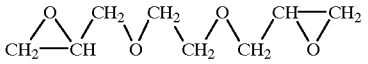

P-1

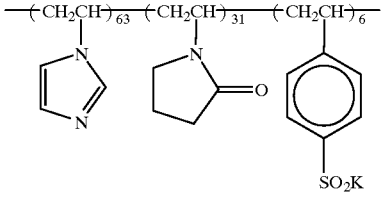

TABLE 4

| Layer structure | Main material | Amount coated ($g/m^2$) |
|---|---|---|
| 4th layer | Gelatin | 0.49 |
| | Matting agent (silica) | 0.01 |
| Third layer | Gelatin | 0.24 |
| | Curing agent (H-3) | 0.25 |
| Second layer | Gelatin | 4.89 |
| | Solvent for silver halide | 5.77 |
| First layer | Gelatin | 0.37 |
| | Curing agent (H-3) | 0.58 |
| | Gelatin primer layer | |
| | 63 $\mu$m PET base | |

H-3

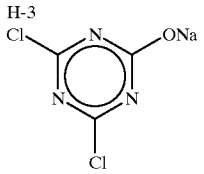

Solvent for silver halide

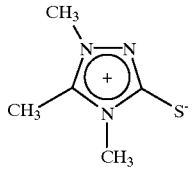

Next, light-sensitive materials 102 to 107 were made in the same manner as for the light-sensitive material 101 except that to the combination of the coupler and the developing agent in the light-sensitive material 101 was added the compound represented by the general formula (III) of the present invention in an amount of 5 mol % of the coupler. Further, light-sensitive materials 108 to 120 were made in the same manner as for the light-sensitive material 101 except that the coupler and the developing agent in the light-sensitive material 101 were substituted by a combination of a coupler and a developing agent shown in Table 5 in equimolar amounts, and the compound represented by the general formula (III) of the present invention was added in an amount of 5 mol % of the coupler.

The light-sensitive material thus produced was exposed image-wise and 15 cc/$m^2$ of water at 40° C. was applied thereto. The light-sensitive material was then laminated with the first treating member R-1 and was heated from the back side of the light-sensitive materials for 17 seconds at 83° C. with a heat drum. The first treating member R-1 was peeled away from the light-sensitive material and 15 cc/$m^2$ of water at 40° C. was again applied thereto. The light-sensitive material was then laminated with the second treating member R-2 and was heated for 17 seconds at 83° C. The second treating member R-2 was peeled away from the light-sensitive material. Then, the Dmin (minimum density) and Dmax (maximum density) for the image thus obtained were determined using a Fuji-system density measuring device (manufactured by Fuji Photo Film Co., Ltd.).

The results are shown in Table 5.

As is apparent from Table 5, when the compound of the present invention was used, low Dmin and high Dmax are shown, and discrimination is excellent.

TABLE 5

| Light-sensitive material | Coupler | Developing agent | Compound represented by general formula (III) | Photographic property $D_{min}$ | Photographic property $D_{max}$ | Note |
|---|---|---|---|---|---|---|
| 101 | Y:Y-1 | II-22 | None | 2.02 | 2.69 | Comparative example |
| | M:M-1 | I-19 | | 1.55 | 2.30 | |
| | C:C-1 | I-19/3 | | 1.61 | 2.19 | |
| 102 | Y:Y-1 | II-22 | III-37 | 1.09 | 2.81 | Present invention |
| | M:M-1 | I-19 | III-39 | 0.88 | 2.51 | |
| | C:C-1 | I-19/3 | III-40 | 0.70 | 2.31 | |
| 103 | Y:Y-1 | II-22 | III-5 | 0.98 | 2.88 | Present invention |
| | M:M-1 | I-19 | III-5 | 0.66 | 2.78 | |
| | C:C-1 | I-19/3 | III-5 | 0.43 | 2.61 | |
| 104 | Y:Y-1 | II-22 | III-1 | 0.87 | 3.02 | Present invention |
| | M:M-1 | I-19 | III-1 | 0.48 | 2.91 | |
| | C:C-1 | I-19/3 | III-1 | 0.33 | 2.81 | |
| 105 | Y:Y-1 | II-22 | III-7 | 0.84 | 3.03 | Present invention |
| | M:M-1 | I-19 | III-7 | 0.49 | 2.95 | |
| | C:C-1 | I-19/3 | III-7 | 0.30 | 2.88 | |

TABLE 5-continued

| Light-sensitive material | Coupler | Developing agent | Compound represented by general formula (III) | Photographic property $D_{min}$ | Photographic property $D_{max}$ | Note |
|---|---|---|---|---|---|---|
| 106 | Y:Y-1 | II-22 | III-9 | 1.10 | 2.84 | Present invention |
| | M:M-1 | I-19 | III-12 | 0.60 | 2.68 | |
| | C:C-1 | I-19/3 | III-13 | 0.36 | 2.64 | |
| 107 | Y:Y-1 | II-22 | III-14 | 1.06 | 2.87 | Present invention |
| | M:M-1 | I-19 | III-14 | 0.60 | 2.74 | |
| | C:C-1 | I-19/3 | III-14 | 0.37 | 2.68 | |
| 108 | Y:Y-2 | II-14 | III-1 | 1.06 | 2.87 | Present invention |
| | M:M-2 | I-1 | III-1 | 0.60 | 2.74 | |
| | C:C-2 | I-2 | III-1 | 0.37 | 2.68 | |
| 109 | Y:Y-2 | II-14 | III-7 | 1.04 | 2.88 | Present invention |
| | M:M-2 | I-1 | III-7 | 0.58 | 2.77 | |
| | C:C-2 | I-2 | III-7 | 0.40 | 2.68 | |
| 110 | Y:Y-2 | II-14 | III-14 | 1.0 | 2.88 | Present invention |
| | M:M-2 | I-1 | III-14 | 0.72 | 2.81 | |
| | C:C-2 | I-2 | III-14 | 0.36 | 2.74 | |
| 111 | Y:Y-2 | II-16 | III-1 | 1.15 | 2.75 | Present invention |
| | M:M-2 | I-3 | III-1 | 0.63 | 2.60 | |
| | C:C-2 | I-4 | III-1 | 0.41 | 2.56 | |
| 112 | Y:Y-2 | II-16 | III-7 | 1.22 | 2.78 | Present invention |
| | M:M-2 | I-3 | III-7 | 0.69 | 2.66 | |
| | C:C-2 | I-4 | III-7 | 0.42 | 2.61 | |
| 113 | Y:Y-2 | II-16 | III-14 | 1.22 | 2.79 | Present invention |
| | M:M-2 | I-3 | III-14 | 0.69 | 2.66 | |
| | C:C-2 | I-4 | III-14 | 0.42 | 2.60 | |
| 114 | Y:Y-2 | II-16 | III-21 | 1.20 | 2.80 | Present invention |
| | M:M-2 | I-3 | III-21 | 0.67 | 2.70 | |
| | C:C-2 | I-4 | III-21 | 0.46 | 2.67 | |
| 115 | Y:Y-2 | II-16 | III-25 | 1.04 | 2.70 | Present invention |
| | M:M-2 | I-5 | III-25 | 0.57 | 2.58 | |
| | C:C-2 | I-6 | III-25 | 0.44 | 2.50 | |
| 116 | Y:Y-2 | II-16 | III-27 | 1.05 | 2.71 | Present invention |
| | M:M-2 | I-5 | III-27 | 0.58 | 2.49 | |
| | C:C-2 | I-6 | III-27 | 0.45 | 2.51 | |
| 118 | Y:Y-2 | II-22 | III-28 | 1.06 | 2.73 | Present invention |
| | M:M-2 | I-7 | III-28 | 0.57 | 2.51 | |
| | C:C-2 | I-8 | III-28 | 0.44 | 2.53 | |
| 119 | Y:Y-2 | II-22 | III-25 | 1.07 | 2.69 | Present invention |
| | M:M-2 | I-7 | III-25 | 0.55 | 2.53 | |
| | C:C-2 | I-8 | III-25 | 0.45 | 2.51 | |
| 120 | Y:Y-2 | II-22 | III-27 | 1.08 | 2.71 | Present invention |
| | M:M-2 | I-7 | III-27 | 0.55 | 2.54 | |
| | C:C-2 | I-8 | III-27 | 0.44 | 2.53 | |

C-2

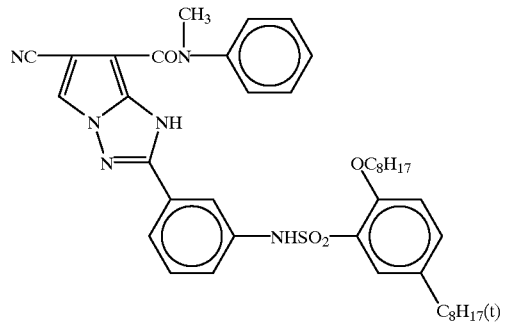

-continued

M-2

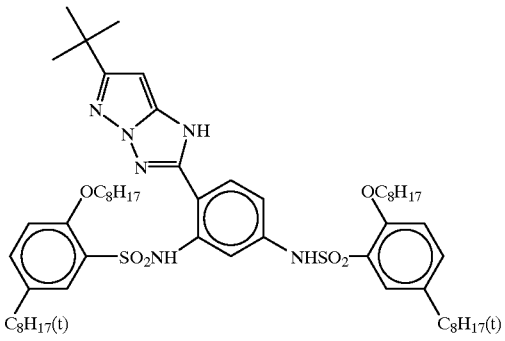

Y-2

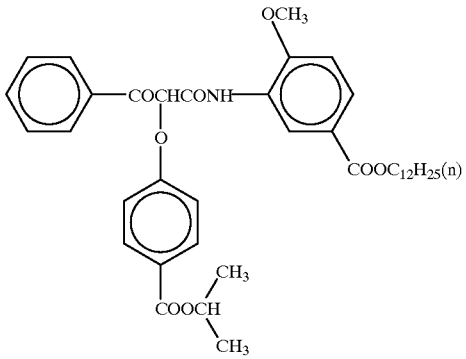

What is claimed is:

1. A silver halide color photographic light-sensitive material comprising a support and a photographic constitutional layer provided thereon which includes at least one photographic light-sensitive layer containing a light-sensitive silver halide, a developing agent and a binder, wherein said light-sensitive material comprises at least one compound represented by the following general formula (I) or (II) as said developing agent and at least one compound represented by the following general formula (IV):

General formula (I)

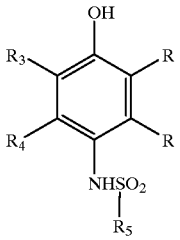

wherein, $R_1$, $R_2$, $R_3$ and $R_4$ each independently represents a hydrogen atom, halogen atom, alkyl group, aryl group, alkylcarbonamide group, arylcarbonamide group, alkylsufonamide group, arylsulfonamide group, alkoxy group, aryloxy group, alkylthio group, arylthio group, alkylcarbamoyl group, arylcarbamoyl group, carbamoyl group, alkylsulfamoyl group, arylsulfamoyl group, sulfamoyl group, cyano group, alkylsulfonyl group, arylsulfonyl group, alkoxycarbonyl group, aryloxycarbonyl group, alkylcarbonyl group, arylcarbonyl group or acyloxy group; and R, represents an alkyl group, aryl group or heterocyclic group:

General formula (II)

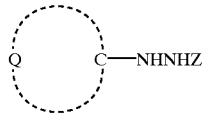

wherein, Z represents a carbamoyl group, acyl group, alkoxycarbonyl group, aryloxycarbonyl group, sulfonyl group or sulfamoyl group; and Q represents a group of atoms which forms an unsaturated ring together with carbon atoms:

(IV):

General formula (IV)

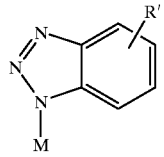

wherein, R' represents a substituted or unsubstituted aliphatic hydrocarbon group having 4 to 16 carbon atoms, an alkenyl group, alkynyl group, aralkyl group, aryl group, heterocyclic group, alkoxy group, aryloxy group, amino group, acylamino group, ureide group, urethane group, sulfonamide group, sulfamoyl group, carbamoyl group, sulfonyl group, oxycarbonyl group, acyl group, acyloxy group, alkylthio group or arylthio group; and M represents a hydrogen atom, alkaline metal atom or ammonium group.

2. A silver halide color photographic light-sensitive material comprising a support and a photographic constitutional layer provided thereon which includes at least one photographic light-sensitive layer containing a light-sensitive silver halide, a developing agent and a binder, wherein the light-sensitive material, after exposure, is contacted with a processing material comprising a support and a constitutional layer provided thereon which includes a processing layer containing at least a base and/or a base precursor, in the presence of water present between the light-sensitive material and the processing material in an amount of 10% to 100% of that required to maximally swell the all coated layers of the materials, and subsequently heated to form an image in the light-sensitive material, wherein said light-sensitive material comprises at least one compound represented by the following general formula (I) or (II) as said developing agent and at least one compound represented by the following general formula (IV):

General formula (I)

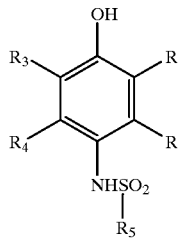

wherein, $R_1$, $R_2$, $R_3$ and $R_4$ each independently represents a hydrogen atom, halogen atom, alkyl group, aryl group, alkylcarbonamide group, arylcarbonamide group, alkylsufonamide group, arylsulfonamide group, alkoxy group, aryloxy group, alkylthio group, arylthio group, alkylcarbamoyl group, arylcarbamoyl group, carbamoyl group, alkylsulfamoyl group, arylsulfamoyl group, sulfamoyl group, cyano group, alkylsulfonyl group, arylsulfonyl group, alkoxycarbonyl group, aryloxycarbonyl group, alkylcarbonyl group, arylcarbonyl group or acyloxy group; and $R_5$ represents an alkyl group, aryl group or heterocyclic group:

General formula (II)

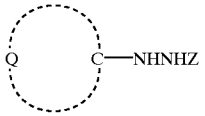

wherein, Z represents a carbamoyl group, acyl group, alkoxycarbonyl group, aryloxycarbonyl group, sulfonyl group or sulfamoyl group; and Q represents a group of atoms which forms an unsaturated ring together with carbon atoms:

General formula (IV)

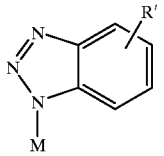

wherein, R' represents a substituted or unsubstituted aliphatic hydrocarbon group having 4 to 16 carbon atoms, an alkenyl group, alkynyl group, aralkyl group, aryl group, heterocyclic group, alkoxy group, aryloxy group, amino group, acylamino group, ureide group, urethane group, sulfonamide group, sulfamoyl group, carbamoyl group, sulfonyl group, oxycarbonyl group, acyl group, acyloxy group, alkylthio group or arylthio group; and M represents a hydrogen atom, alkaline metal atom or ammonium group.

3. The material according to claim 2, further comprising a coupler which forms a dye by conducting a coupling reaction with the oxidation product of a developing agent represented by the general formula (I) or (II).

4. The material according to claim 2, wherein said light-sensitive material comprises the compound represented by the general formula (II) as said developing agent, and the total number of carbon atoms of said unsaturated ring and an optional substituent thereof is from 1 to 30.

5. The material according to claim 2, wherein tabular particles of said light-sensitive silver halide have an aspect ratio of 8 or more, wherein said tabular particles occupy 50% or more of the projected area of all particles.

6. A method of forming a color image, wherein the silver halide color photographic light-sensitive material according to claim 2, after image-wise exposure, is contacted with a processing material, in the presence of water between the light-sensitive material in an amount of 10% to 100% of that required to maximally swell the all coated layers of the materials, and subsequently heated at a temperature from 60° C. to 100° C for 5 seconds to 60 seconds to from an image in the light-sensitive material.

7. The method according to claim 6, wherein said light-sensitive material comprises the compound represented by the general formula (II) as said developing agent, and the total number of carbon atoms of said unsaturated ring and an optional substituent thereof is from 1 to 30.

8. The method according to claim 6, wherein tabular particles of said light-sensitive silver halide have an aspect ratio of 8 or more, wherein said tabular particles occupy 50% or more of the projected area of all particles.

* * * * *